US007754403B2

(12) United States Patent
Kondoh et al.

(10) Patent No.: US 7,754,403 B2
(45) Date of Patent: Jul. 13, 2010

(54) ELECTROPHOTOCONDUCTOR AND IMAGE FORMING APPARATUS

(75) Inventors: Akihiro Kondoh, Nara (JP); Hiroshi Sugimura, Habikino (JP); Takatsugu Obata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 626 days.

(21) Appl. No.: 11/708,580

(22) Filed: Feb. 21, 2007

(65) Prior Publication Data

US 2007/0207395 A1 Sep. 6, 2007

(30) Foreign Application Priority Data

Mar. 3, 2006 (JP) ..... 2006-058334

(51) Int. Cl.
*G03G 5/047* (2006.01)

(52) U.S. Cl. ..... 430/58.85; 430/72; 430/73

(58) Field of Classification Search ..... 430/58.65, 430/58.85, 72, 73
See application file for complete search history.

(56) References Cited

U.S. PATENT DOCUMENTS

| | | | | |
|---|---|---|---|---|
| 4,123,269 | A | 10/1978 | Von Hoene et al. | |
| 5,486,439 | A | 1/1996 | Sakakibara et al. | |
| 5,639,581 | A | 6/1997 | Iwasaki et al. | |
| 5,641,598 | A * | 6/1997 | Tanaka et al. | 430/58.85 |
| 5,734,003 | A | 3/1998 | Iwasaki et al. | |
| 5,942,363 | A | 8/1999 | Tanaka et al. | |
| 6,093,784 | A | 7/2000 | Tamura et al. | |
| 6,265,122 | B1 | 7/2001 | Itami et al. | |
| 6,664,361 | B2 | 12/2003 | Sasaki et al. | |
| 2006/0204871 | A1 | 9/2006 | Kondoh et al. | |

FOREIGN PATENT DOCUMENTS

| | | |
|---|---|---|
| JP | 52-4188 | 2/1977 |
| JP | 54-150128 | 11/1979 |
| JP | 54-151955 | 11/1979 |
| JP | 55-42380 | 3/1980 |
| JP | 55-52063 | 4/1980 |
| JP | 58-32372 | 7/1983 |
| JP | 58-198043 | 11/1983 |
| JP | 2-190862 | 7/1990 |
| JP | 3-221522 | 9/1991 |
| JP | 4-11627 | 1/1992 |
| JP | 5-32625 A | 2/1993 |
| JP | 6-295077 | 10/1994 |
| JP | 7-48324 | 2/1995 |
| JP | 7-228557 | 8/1995 |
| JP | 7-258399 | 10/1995 |
| JP | 8-62864 | 3/1996 |
| JP | 8-176293 | 7/1996 |
| JP | 9-194442 | 7/1997 |
| JP | 2000-136169 | 5/2000 |
| JP | 2000-242019 | 9/2000 |
| JP | 2002-249472 | 9/2002 |
| JP | 2004-269377 | 9/2004 |
| JP | 2004-334125 | 11/2004 |
| JP | 2005-206507 A | 8/2005 |

OTHER PUBLICATIONS

Diamond, A.S., ed., Handbook of Imaging Materials, Marcel Dekker, Inc., NY, 1991, pp. 383, 384, 395, and 396.*
Japanese Patent Office machine-assisted translation of JP 2004-206507 (pub. Aug. 2005).*
Certified English translation of Claim 1 of Japanese Patent Publication No. SHO 58(1983)-32372 as published on Jul. 12, 1988.

* cited by examiner

*Primary Examiner*—Janis L Dote
(74) *Attorney, Agent, or Firm*—Nixon & Vanderhye P.C.

(57) ABSTRACT

An organic photoconductive material which is useful as a raw material compound for a variety of functional materials and makes it possible to implement an electrophotoconductor which is excellent in terms of the charge transporting performance, excellent in terms of dissolution in solvents and compatibility with resins, and excellent in terms of both the electrical properties and durability is provided. An example is an asymmetric bishydroxy compound which can be represented by the following structural formula (1aa). This compound is contained in a charge transforming layer 4 or a surface protective layer 5 of an electrophotoconductor 18. As a result, an electrophotoconductor 18 which is excellent in terms of the electrical properties and durability and can stably form high quality images without image defects such as black dots can be implemented.

(1 aa)

8 Claims, 5 Drawing Sheets

ELECTROPHOTOCONDUCTOR AND IMAGE FORMING APPARATUS

CROSS-REFERENCES TO RELATED APPLICATIONS

This application is related to Japanese Patent Application No. 2006-058334 filed on 3 Mar. 2006, whose priority is claimed under 35 USC §119, the disclosure of which is incorporated by reference in its entirety.

BACKGROUND OF THE INVENTION

1. Field of the Invention

The present invention relates to an asymmetric bishydroxy compound and an electrophotoconductor using this compound as well as an image forming apparatus having this electrophotoconductor.

2. Description of the Related Art

Image forming apparatuses in an electrophotographic system which form an image using an electrophotographic technology (hereinafter referred to as electrophotographic apparatuses) are widely used in copiers, printers, facsimile machines and the like.

In electrophotographic apparatuses, an image is formed through the following electrophotographic process. First, a photosensitive layer of an electrophotoconductor (hereinafter simply referred to as photoconductor) which is provided in the apparatus is charged, and after that, exposed to light so that an electrostatic latent image is formed. The formed electrostatic latent image is developed so that a toner image is formed, and the formed toner image is transferred and fixed to a transfer material, such as paper for recording, and thus, a desired image is formed on the transfer material.

In recent years, the electrophotographic technology has been used not only in the field of copiers, but also in the field of printing plate materials, slide films, microfilms and the like where a silver salt photographic technology was used conventionally, and thus, is applied to a fast speed printer having a laser, a light emitting diode (abbreviated as LED), a cathode ray tube (abbreviated as CRT) or the like as the light source. As the range of application of the electrophotographic technology expands, the demand for high quality electrophotographic sensitive bodies becomes higher.

As for the electrophotographic sensitive bodies, conventional inorganic sensitive bodies having a photosensitive layer, of which the main component is an inorganic photoconductive material, such as selenium, zinc oxide or cadmium sulfide, have been widely used.

The inorganic sensitive bodies have defects such that it is difficult to form a film of the photosensitive layer, which lacks plasticity, and manufacturing costs are high though they have basic properties as a photoconductor to a certain extent. On top of this, inorganic photoconductive materials have a generally high toxicity, and thus, there is a large restriction in the manufacture and handling.

As described above, there are many defects in inorganic photoconductive materials and inorganic sensitive bodies using these, and therefore, research and development of organic photoconductive materials have been progressing.

In recent years, organic photoconductive materials have been widely researched and developed so as to be used for an electrostatic recording element, such as an electrophotoconductor, and in addition, have started being applied to a sensor element, an organic electroluminescent (abbreviated as EL) element and the like.

Organic sensitive bodies using an organic photoconductive material are easily formed as a film for a photosensitive layer, which is excellent in flexibility, and in addition, there are advantages such that the photoconductor is light, highly transparent and can be easily designed as a photoconductor exhibiting excellent sensitivity for a wide wavelength range in accordance with an appropriate method for increasing the sensitivity, and therefore, organic sensitive bodies have been developed gradually as the mainstream of electrophotographic sensitive bodies.

Though organic sensitive bodies have defects in the sensitivity and durability at an early stage, these defects have been significantly improved upon through the development of a function separation type electrophotoconductor where the charge generating function and the charge transporting function are allocated to separate substances. Furthermore, this function separation type photoconductor has an advantage where a material for forming the photosensitive layer can be selected from a wide range so that an electrophotoconductor having arbitrary properties can be fabricated relatively easily in addition to the above described advantages of organic sensitive bodies.

There are a multilayer type and a single layer type in the function separation type sensitive bodies, and the single layer type is provided with a photosensitive layer, which is formed of a single layer where a charge generating substance, to which a charge generating function is allocated, and a charge transporting substance, to which a charge transporting function is allocated, are covariated, in a resin having binding properties, which is referred to as a binder resin.

Meanwhile, the function separation type photoconductor of the multilayer type is provided with a photosensitive layer which is formed of a multilayer where a charge generating layer that is formed by dispersing a charge generating substance in a binder resin and a charge transporting layer that is formed by dispersing a charge transporting substance in a binder resin are layered on top of each other.

As for the charge generating substance used in the function separation type photoconductor, a variety of substances, such as a phthalocyanine pigment, squarylium color, an azo pigment, a perylene pigment, a polycyclic quinone pigment, cyanine color, a squaric acid dye and a pyrylium salt based color, and a variety of materials having strong resistance to light and a high ability to generate charge have been proposed.

In addition, as for the charge transporting substance, a variety of compounds, such as a pyrazoline compound (see, for example, JP-B S52-4188 (1977)), a hydrazone compound (see, for example, JP-A S54-150128 (1979), JP-B S55-42380 (1980), and JP-A S55-52063 (1980)), a triphenylamine compound (see, for example, JP-B S58-32372 (1983) and JP-A H2-190862 (1990)) and a stilbene compound (see, for example, JP-A S54-151955 (1979) and JP-A S58-198043 (1983)), are known.

Recently, compounds having a condensation polycyclic type hydrocarbon system at its center nucleus, for example, a pyrene derivative, a naphthalene derivative and a terphenyl derivative (see, for example, JP-A H7-48324 (1995)) have also been developed.

The charge transporting substance is required to be:

(1) stable against light and heat, (2) stable against active substances, such as ozone, nitrogen oxide (general formula: NOx) and nitric acid, which are generated through corona discharge when the surface of the photoconductor is charged, (3) excellent in the charge transporting performance, (4) excellent in the compatibility with an organic solvent and a binder resin, and (5) easy to manufacture and inexpensive.

Though the above described charge transporting substance partially satisfies these requirements, it has not yet highly satisfied all of these.

In addition, though as for the properties of the sensitive bodies, it is required that an excellent sensitivity is provided even when used under an environment having a low temperature, and that a change in the properties due to a change in the surrounding environment, for example, temperature and humidity, is small such that stability in the environment is excellent, a charge transporting substance which can provide these properties has not yet been obtained.

Meanwhile, it has been recently required from among the above described requirements that the charge transporting substance is particularly excellent in the charge transporting performance.

As for the properties of the photoconductor, for example, as the electrophotographic apparatuses, such as copiers and printers, are miniaturized and the speed of image formation increases, it is required for the sensitivity to be increased, and the charge transporting performance of the charge transporting substance is required to be increased as a means for realizing an increase in the sensitivity of the photoconductor.

In addition, in the high speed electrophotographic process, the time from the exposure to light to development is short, and therefore, a photoconductor having excellent responsiveness to light is required. When the responsiveness to light of the photoconductor is poor, the rate of attenuation of the surface potential in the photosensitive layer due to exposure to light becomes low, the residual potential increases and the photoconductor is repeatedly used in a state where the surface potential is not sufficiently attenuated. Therefore, the surface charge is not sufficiently deleted through the exposure to light from the portion from which the surface charge should be deleted, and a problem arises at an early stage such that the density of the image is lowered.

Meanwhile, in the function separation type photoconductor, the charge that has been generated by the charge generating substance through light absorption is transported to the surface of the photosensitive layer by the charge transporting substance, and thereby, the surface charge of the photosensitive layer in the portion irradiated with light is deleted, and therefore, the responsiveness to light depends on the charge transporting performance of the charge transporting substance. Accordingly, an excellent charge transporting performance is required for the charge transporting substance in the point of view of gaining a photoconductor which has sufficient responsiveness to light so that a high quality image can be formed even in a high speed electrophotographic process.

In addition, high durability is also required for the electrophotographic apparatus. In order to achieve this, it becomes necessary for the electrophotoconductor to be excellent in durability so that it can operate stably over a long period of time.

Accordingly, the durability of the photoconductor is greatly affected by the abrasion resistance of the outermost layer of the photoconductor.

In general, when a photoconductor is mounted in an electrophotographic apparatus for use, the outermost layer of the photoconductor rubs against a contact member, such as a cleaning blade, and a charging roller, and it cannot be avoided that a portion thereof is shaved off. In the case where the amount of the outermost layer of the photoconductor that is shaved off through rubbing, that is to say, the amount of reduction in the film is great, the charge holding ability of the photoconductor is lowered, causing a problem where the quality of the image is lowered. Therefore, it is required for the outermost layer of the photoconductor to be excellent in the resistance to being shaved off by the above described contact member, that is to say, the abrasion resistance.

As for the method for increasing abrasive resistance of the outermost layer in the photoconductor where the charge transporting layer is the outermost layer, there is one possible method for increasing the content of the binder resin that is contained in the charge transporting layer.

In the case where the content of the binder resin is increased, however, the content of the charge transporting substance in the charge transporting layer is relatively lowered, and thus, a problem arises where the charge transporting performance of the charge transporting layer is decreased and the responsiveness to light is decreased.

In addition, in the case where compatibility between the charge transporting substance and the binder resin is poor, a problem arises where a charge transporting substance is crystallized at the time of film formation in such a manner that a uniform charge transporting layer cannot be obtained, and defects in the image are caused.

Therefore, it is difficult to implement a photoconductor where electrical properties, such as responsiveness, and durability are compatible.

In order to solve the above described problems in electrophotographic sensitive bodies, it has been attempted to provide a charge transporting performance to the binder resin and to reduce the amount of the added charge transporting material, and thus, the development of a binder resin which contains composition units having a charge transporting performance, a so-called polymer photoconductive material, has been in progress.

As concrete examples of these, polycarbonate resins having a triaryl amine structure in the main chain or a branch chain (see, for example, JP-A 2004-334125, JP-A H3-221522 (1991), JP-A H4-11627 (1992), JP-A H6-295077 (1994), JP-A H7-258399 (1995), and JP-A H8-62864 (1996)), polyether resins having a triaryl amine structure in the main chain (see, for example, JP-A H8-176293 (1996)) and the like can be cited.

These resins are synthesized using a compound or compounds having a triaryl amine structure and a hydroxyl group (for example, JP-A H7-228557 (1995), JP-A H9-194442 (1997), JP-A 2000-136169, and JP-A 2002-249472) as a monomer(s), and homopolymerizing this compound or copolymerizing these compounds.

However, triaryl amine based compounds disclosed in JP-A H7-228557 (1995), JP-A H9-194442 (1997), JP-A 2000-136169, and JP-A 2002-249472 and the like do not have sufficient charge transporting performance, and resins having a triphenylamine structure, which are obtained by polymerizing these compounds and disclosed in JP-A H3-221552 (1991), JP-A H4-11627 (1992), JP-A H6-295077 (1994), JP-A H7-258399 (1995), JP-A H8-62864 (1996), JP-A H8-176293 (1996) and the like, are not at a level where the charge transporting performance and the physical strength are sufficiently satisfied.

In order to solve problems with these polymer photoconductive materials, a bishydroxy substituted enamine compound having an enamine structure and two hydroxyl groups (hereinafter also referred to as bishydroxy enamine compound) has been proposed as a compound, which is useful as a raw material compound of a polymer material, and as a charge transporting substance as it is (see JP-A 2004-269377).

In addition, as another means for achieving an increase in the durability of sensitive bodies, the photosensitive layer has been coated with a surface protective layer formed of a resin or the like. The surface protective layer becomes the outermost layer of a photoconductor where a surface protective layer has been provided, and therefore, the surface protective layer is required to be excellent in the charge transporting performance and in the abrasion resistance. As for a surface protective layer which satisfies these requirements, a surface protective layer made of a siloxane based resin having a composition unit having a charge transporting performance has been proposed (see JP-A 2000-242019).

Nitrogen atoms included in the enamine skeleton have the same substituent groups in the bishydroxy enamine compound described in JP-A 2004-269377, which thus has a high level of symmetry of the molecular structure and excellent crystallinity, and therefore, a problem arises where this compound lacks solubility in the solvent and compatibility with the binder resin. Therefore, in the case where this compound is used as a charge transporting substance in the charge transporting layer, for example, this compound partially remains without being dissolved in the liquid for application for forming a layer in such a manner that this undissolved portion exists in the charge transporting layer in a crystal state, creating a harmful influence in such a manner as to cause defects in the image.

In addition, the raw material compound, which is used when the compound disclosed in JP-A 2004-269377 is manufactured, and the intermediate that is created during the manufacturing process also have high crystallinity and poor solubility in the solvent, and therefore, there is also a problem where it is difficult for the reaction to progress smoothly. In addition, when a polymer material is manufactured using the compound disclosed in JP-A 2004-269377 as the raw material compound, a problem arises where the reaction is poor due to the poor solubility. In addition, an expensive material must be used for the creation of the enamine structure, and therefore, this is not preferable from the point of view of production.

Meanwhile, the surface protective layer described in JP-A 2000-242019 does not have a sufficient charge transporting performance, and at present, a surface protective layer which is excellent in both the charge transporting performance and the physical strength has not been realized.

In addition, in the photoconductor disclosed in JP-A 2000-242019, the charge transporting substance in the charge transporting layer and the structure unit of the siloxane based resin that forms the surface protective layer, which has a charge transporting function, are incompatible, and thereby, a potential barrier is formed at the interface between the surface protective layer and the charge transporting layer, making the injection of a charge insufficient, and thus, a problem arises where the sensitivity and the responsiveness to light are lowered.

SUMMARY OF THE INVENTION

Accordingly, an object of the present invention is to provide at a low cost an electrophotoconductor having an excellent charge transporting performance as well as excellent solubility in the solvent and compatibility with the resin where no partial crystals are created at the time of film formation, and the electrical properties and the durability are both excellent, and to provide an organic photoconductive material which is useful as a raw material compound for a variety of functional materials and an electrophotoconductor using this organic photoconductive material as well as an image forming apparatus having this electrophotoconductor.

As a result of diligent efforts and research, the present inventors found unexpectedly that an asymmetric bishydroxy compound has an excellent charge transporting performance as well as excellent solubility in solvents and compatibility with resins, and furthermore, found that the asymmetric bishydroxy compound is extremely useful for an electrophotoconductor and an image forming apparatus having this as an organic photoconductive material, and thereby, completed the present invention.

The present invention thus provides an electrophotoconductor, characterized by containing an asymmetric bishydroxy compound (hereinafter referred to as asymmetric bishydroxy compound (1)) that can be represented by the following general formula (1):

(1)

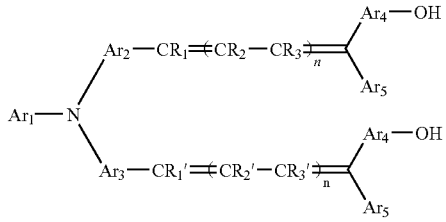

wherein $Ar_1$ is an aryl or heterocyclic group which may have an arbitrary substituent group, $Ar_2$ and $Ar_3$ are different from each other and are an arylene or bivalent heterocyclic group which may have an arbitrary substituent group, $Ar_4$ is an arylene group or bivalent heterocyclic group which may have an arbitrary substituent group, $Ar_5$ is hydrogen atom or an aryl, aralkyl or alkyl group which may have an arbitrary substituent group, $R_1$ and $R_1'$ are hydrogen atom or an alkyl group which may have an arbitrary substituent group, $R_2$, $R_2'$, $R_3$ and $R_3'$ are hydrogen atom or an alkyl, aryl, heterocyclic or aralkyl group which may have an arbitrary substituent group, provided that $R_1$ and $R_1'$, $R_2$ and $R_2'$, and $R_3$ and $R_3'$ may be the same or different groups, respectively, and n is an integer of 0 to 2.

In addition, the present invention provides an electrophotoconductor wherein the above described asymmetric bishydroxy compound is an asymmetric bishydroxy compound (hereinafter referred to as asymmetric bishydroxy compound (2)) of the above described general formula (1), in which one of $Ar_2$ and $Ar_3$ is phenylene group and the other is naphthylene group, and $R_1$, $R_1'$, $R_2$, $R_2'$, $R_3$ and $R_3'$ are all hydrogen atom, can be represented by the following general formula (2):

(2)

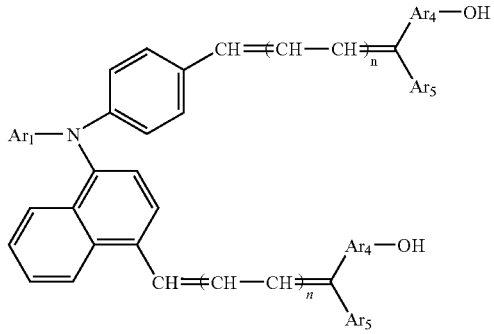

wherein $Ar_1$, $Ar_4$, $Ar_5$ and n are the same meanings as defined in the above described general formula (1).

Concretely, the present invention provides an electrophotoconductor wherein the above described asymmetric bishydroxy compound is an asymmetric bishydroxy compound (hereinafter referred to as asymmetric bishydroxy compound (3)) of the above described general formula (1), in which one of $Ar_2$ and $Ar_3$ is phenylene group and the other is naphthylene group, $Ar_4$ is phenylene group which may have an arbitrary substituent group, $Ar_5$ is hydrogen atom and $R_1$, $R_1'$, $R_2$, $R_2'$, $R_3$ and $R_3'$ are all hydrogen atom, can be represented by the following general formula (3):

(3)

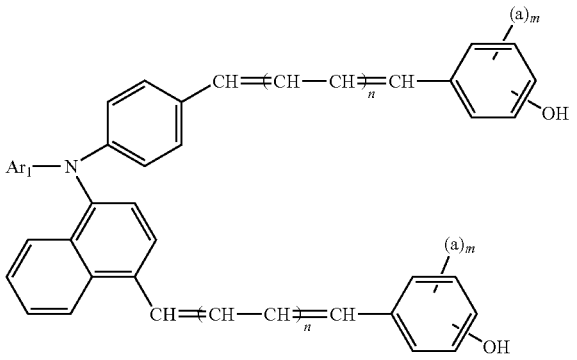

wherein $Ar_1$ and n are the same meanings as defined in the above described general formula (1), "a" is hydrogen atom or an alkyl group or dialkyl amino group which may have an arbitrary substituent group and m indicates an integer of 1 to 4, provided that when m is the plural number, a may be the same or different from each other.

More concretely, the present invention provides an electrophotoconductor wherein the above described asymmetric bishydroxy compound is an asymmetric bishydroxy compound (hereinafter referred to as asymmetric bishydroxy compound (4)) of the above described general formula (1), in which one of $Ar_2$ and $Ar_3$ is phenylene group and the other is naphthylene group, $Ar_4$ is phenylene group, $Ar_5$ is hydrogen atom and $R_1$, $R_1'$, $R_2$, $R_2'$, $R_3$ and $R_3'$ are all hydrogen atom, can be represented by the following general formula (4):

(4)

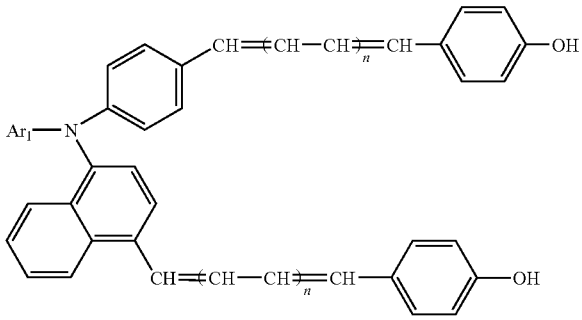

wherein $Ar_1$ and n are the same meanings as defined in the above described general formula (1).

Still more concretely, the present invention provides an electrophotoconductor wherein the above described asymmetric bishydroxy compound is an asymmetric bishydroxy compound (hereinafter referred to as asymmetric bishydroxy compound (5)) of the above described general formula (1), in which one of $Ar_2$ and $Ar_3$ is phenylene group and the other is naphthylene group which may have arbitrary substituent group, $Ar_4$ is phenylene group, $Ar_5$ is hydrogen atom, $R_1$ and $R_1'$ are both hydrogen atom, and n is 0, can be represented by the following general formula (5):

(5)

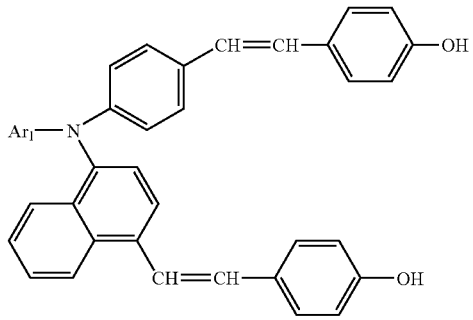

wherein $Ar_1$ is defined in the same manner as in the above described general formula (1).

In addition, the present invention provides an electrophotoconductor characterized in that a photosensitive layer and a surface protective layer are layered on the top of a conductive support in this order and at least either the photosensitive layer or the surface protective layer contains any of the above described asymmetric bishydroxy compounds (1) to (5) alone or as a mixture thereof.

In addition, the present invention provides an electrophotoconductor characterized in that the above described photosensitive layer has a multilayer structure of a charge generating layer containing a charge generating substance and a charge transporting layer containing any of the above described asymmetric bishydroxy compounds (1) to (5) alone or as a mixture thereof.

Furthermore, the present invention provides an image forming apparatus characterized by having:

an electrophotoconductor as that described above;

a charging means for charging the above described electrophotoconductor;

a light exposing means for exposing said charged electrophotoconductor to light; and a developing means for developing an electrostatic latent image that has been formed through exposure to light.

In addition, the present invention provides an image forming apparatus characterized in that the above described image forming apparatus has a contact charge system as a charging means for charging the above described electrophotoconductor.

DESCRIPTION OF THE PREFERRED EXAMPLES

Figure 1:
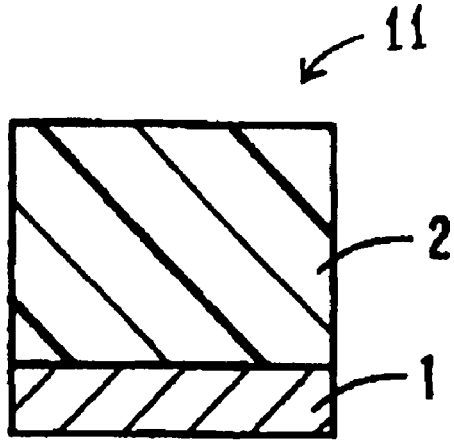
FIG. 1 is a cross sectional diagram schematically showing the configuration of a main portion of a single layer type electrophotoconductor 11 according to an embodiment of the present invention.

All of the asymmetric bishydroxy compounds according to the present invention have excellent charge transporting function, in particular, hole transporting function, in addition to excellent solubility in solvents and compatibility with resins, and therefore, are useful as organic photoconductive materials and appropriate as charge transporting substances for devices including electrostatic recording elements, such as electrophotographic sensitive bodies, sensor elements and EL elements.

Accordingly, when the photosensitive layer or surface protective layer of an electrophotoconductor, for example, contains an asymmetric bishydroxy compound according to the present invention, it becomes possible to provide an electrophotoconductor which has excellent electrical properties, such as charging properties, sensitivity and responsiveness to light, and also excellent durability and stability in the environment.

In addition, all of the asymmetric bishydroxy compounds according to the present invention have excellent solubility in solvents and compatibility with binder resins, and therefore, do not crystallize even in the photosensitive layer and the surface protective layer, and thus, disperse in a uniform state.

Accordingly, an electrophotoconductor containing an asymmetric bishydroxy compound according to the present invention can be used, and thereby, a high quality image which does not have image defects, such as black dots, can be stably formed in a variety of environments.

In addition, an electrophotoconductor according to the present invention can provide a high quality image due to its excellent responsiveness to light, even when used in a high speed electrophotographic process.

Furthermore, the asymmetric bishydroxy compounds according to the present invention are useful as raw material compounds for polymer materials, such as polycarbonate resins, polyether resins, polyester resins and polyurethane resins, and the asymmetric bishydroxy compounds according to the present invention can be used as a monomer, so that a polymer photoconductive material having an excellent charge transporting function can be easily obtained.

Among the asymmetric bishydroxy compounds according to the present invention, the asymmetric bishydroxy compound (2) is preferable, the asymmetric bishydroxy compound (3) is more preferable, the asymmetric bishydroxy compound (4) is still more preferable, and the asymmetric bishydroxy compound (5) is most preferable, taking into consideration chemical stability in terms of decomposition and change in quality of a chemical substance, availability of the material, ease of manufacture, yield and cost of manufacture.

In addition, the present invention provides an electrophotoconductor which contains an asymmetric bishydroxy compound according to the present invention in the photosensitive layer. The electrophotoconductor has excellent electrical properties, such as sensitivity and responsiveness, and durability, and does not have crystallized portions which may cause image defects in the photosensitive layer. High quality images having no image defects, such as black dots, can be stably formed using this electrophotoconductor.

In addition, the present invention provides an electrophotoconductor which contains an asymmetric bishydroxy compound according to the present invention in the surface protective layer. The asymmetric bishydroxy compound according to the present invention does not crystallize and is dispersed in a uniform state in this surface protective layer, and therefore, a sufficient charge transporting function can be obtained.

Accordingly, the electrophotoconductor according to the present invention has excellent physical strength, and in addition, excellent electrical properties, such a sensitivity and responsiveness. High quality images having no image defects, such as black dots, can be formed, even when used repeatedly over a long period of time using this electrophotoconductor.

In addition, the present invention provides an image forming apparatus having an electrophotoconductor as that described above.

That is to say, the electrophotoconductor according to the present invention contains an asymmetric bishydroxy compound according to the present invention in the photosensitive layer or the surface protective layer, and therefore, has excellent electrical properties, such as charging properties, sensitivity and responsiveness to light, as well as excellent durability. In addition, the asymmetric bishydroxy compound according to the present invention does not crystallize and is uniformly dispersed in the photosensitive layer or the surface protective layer of the electrophotoconductor according to the present invention.

Accordingly, in the image forming apparatus according to the present invention, high quality images having no image defects such as black dots can be stably formed over a long period of time in a variety of environments.

In addition, the electrophotoconductor according to the present invention has excellent responsiveness to light and can provide a high quality image even in a high speed electrophotographic process, and therefore, it is possible in the image forming apparatus according to the present invention to increase the speed for image formation.

As the aryl group which may have an arbitrary substituent group and is represented by $Ar_1$ in the general formulas (1) to (5), aryl groups substituted with an alkyl group of which the carbon number is 1 to 4 and an alkoxy group of which the carbon number is 1 to 4, such as phenyl, tolyl, methoxyphenyl and naphthyl, can be cited. From among these, phenyl, tolyl, methoxy phenyl, naphthyl and the like are preferable.

In addition, as the heterocyclic group which may have an arbitrary substituent group and is represented by $Ar_1$ in the general formulas (1) to (5), heterocyclic groups having an alkyl group of which the carbon number is 1 to 4 as a substituent group, such as thienyl and benzothiazolyl, can be cited.

As the arylene group which may have an arbitrary substituent group and is represented by $Ar_2$ and $Ar_3$ in the general formula (1) and $Ar_4$ in the general formulas (1) and (2), arylene groups which may have a substituent group selected from the group consisting of alkyl groups of which the carbon number is 1 to 4 and alkoxy groups of which the carbon number is 1 to 4, such as p-phenylene, m-phenylene, methyl-p-phenylene, methoxy-p-phenylene, 1,4-naphthylene, benzoxazolene and biphenylilene, can be cited. From among these, p-phenylene, m-phenylene, methyl-p-phenylene, methoxy-p-phenylene, 1,4-naphthylene and the like are preferable, and p-phenylene, 1,4-naphthylene and the like are particularly preferable.

In addition, as the bivalent heterocyclic group which may have an arbitrary substituent group and is represented by $Ar_2$ and $Ar_3$ in the general formula (1) and $Ar_4$ in the general formulas (1) and (2), 1,4-furandiyl, 1,4-thiophendiyl, 2,5-benzofurandiyl, 2,5-benzoxazolediyl and N-ethylcarbazole-3,6-diyl groups can be cited.

Here, a case where one of $Ar_2$ and $Ar_3$ is a p-phenylene group and the other is a 1,4-naphthylene group in the above described general formula (1), that is to say, the case of the general formula (2) is particularly preferable, because the material cost is low and synthesis is easy.

Furthermore, a case where $Ar_4$ is phenylene group, that is to say, the case of the general formula (3) is more preferable in terms of the cost of the raw material, availability, ease of synthesis and the yield of synthesis, and furthermore, a case where $Ar_4$ is a p-phenylene group, that is to say, the case of the general formulas (4) and (5) is still more preferable.

As the aryl group which may have an arbitrary substituent group and is represented by $Ar_5$ in the general formulas (1) and (2), aryl groups such as phenyl and tolyl group which may have a substituent group selected from alkyl groups of which the carbon number is 1 to 4 and alkoxy groups of which the carbon number is 1 to 4, can be cited.

From among these, phenyl, methoxy phenyl and the like are preferable.

In addition, in the same manner, as the aralkyl groups which may have an arbitrary substituent group and are represented by $Ar_5$, aralkyl groups such as benzyl can be cited.

Furthermore, in the same manner, as the alkyl group which may have an arbitrary substituent group and is represented by $Ar_5$, alkyl groups which may have a thienyl group, such as methyl, can be cited.

As the alkyl group which may have an arbitrary substituent group and is represented by $R_1$, $R_2$ and $R_3$ in the general formula (1), alkyl groups in straight chain form or branched chain form of which the carbon number is 1 to 4 and which may have a thienyl group, such as methyl, ethyl, isopropyl and n-butyl, can be cited.

In addition, in the same manner, as the aryl group which may have an arbitrary substituent group, aryl groups which may have a substituent group selected from alkyl groups of which the carbon number is 1 to 4 and alkoxy groups of which the carbon number is 1 to 4, such as phenyl, can be cited.

In addition, in the same manner, as the heterocyclic group which may have an arbitrary substituent group, thienyl which may have an alkoxy group of which the carbon number is 1 to 4 can be cited as a substituent group, and aralkyl groups such as benzyl can be cited as the aralkyl group.

As the alkyl group which may have a substituent group and is represented by a in the general formula (3), alkyl groups in straight chain form or branched chain form which are cited as alkyl groups in the above described $R_1$, $R_2$ and $R_3$ can be cited.

In the same manner, as the dialkyl amino group which may have a substituent group, dialkyl amino groups, such as dimethyl amino, can be cited.

The above described asymmetric bishydroxy compound (1) can be manufactured by manufacturing an asymmetric bishydroxy ether compound (9a) or (9b), which is an intermediate, in accordance with, for example, the method shown in the following reaction scheme, and then deprotecting the protective group represented by $R_5$ in the formula for this intermediate.

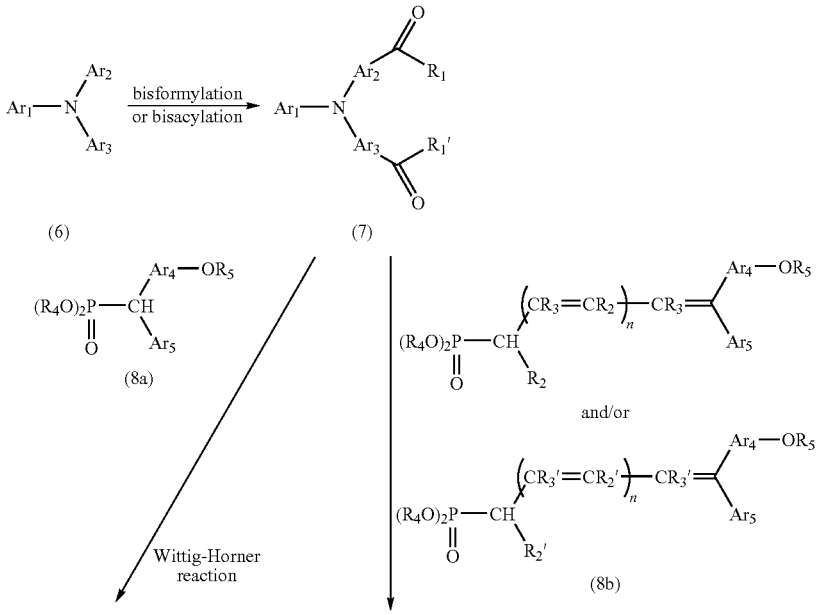

-continued

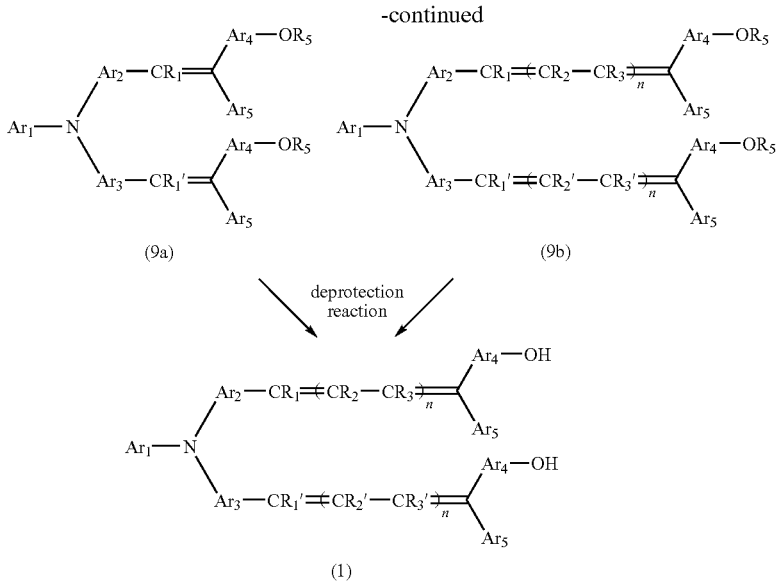

wherein $Ar_1$, $Ar_2$, $Ar_3$, $Ar_4$, $Ar_5$, $R_1$, $R_2$, $R_3$, $R_1'$, $R_2'$, $R_3'$ and n are the same meanings as defined in the above, $R_4$ and $R_5$ represent an alkyl or an aryl group which may have a substituent group, and two $R_4$ or $R_5$ in the same molecule are independent from each other and may be the same or different.

In the above reaction scheme, as the alkyl groups represented by $R_4$ and $R_5$, alkyl groups in straight chain form or branched chain form of which the carbon number is 1 to 4, such as methyl, ethyl, n-propyl, isopropyl, trifluoromethyl and 2-thienyl methyl can be cited. From among these, methyl, ethyl and the like are preferable.

In addition, as the above described aryl group which may have a substituent group, aryl groups which may have a substituent group selected from alkyl groups of which the carbon number is 1 to 4 and alkoxy groups of which the carbon number is 1 to 4, such as phenyl, tolyl, methoxyphenyl and naphthyl can be cited.

Each reaction in the above described reaction scheme can be subjected in the following manner, for example.

Conversion of the amine intermediate represented in the general formula (6) to bisformyl can be achieved in accordance with, for example, a Vilsmeier reaction, which is well known to those skilled in the art. Concretely, this is achieved by heating the amine intermediate (6) and a Vilsmeier reagent while stirring these, and after that, carrying out hydrolysis.

As the Vilsmeier reagent, well known Vilsmeier reagents can be used, and Vilsmeier reagents prepared by reacting oxyphosphorous chloride with one or more types of formamide in an appropriate solvent can be cited as examples.

As the formamide for preparing the Vilsmeier reagent, N,N-dimethyl formamide, N,N-diethyl formamide and N,N-dibutyl formamide, in addition to N-methyl-N-phenyl formamide, N,N-diphenyl formamide and the like, can be cited.

As the above described solvent, 1,2-dichloroethane and the like can be cited as examples, and formamide for preparing Vilsmeier reagents, such as N,N-dimethyl formamide or N,N-diethyl formamide, for example, may also be used as a solvent.

Though the ratio for use of the amine intermediate (6) to the Vilsmeier reagent is not particularly limited, it is preferable to use approximately 2.0 to 2.3 equivalents of the Vilsmeier reagent for 1 equivalent of the amine intermediate (6), taking the efficiency of the reaction and the like into consideration.

This reaction is conducted by heating the mixture to 60° C. to 110° C. for 2 to 8 hours while stirring it.

After the completion of the reaction, an alkali is added to the mixture that has reacted, which is thus hydrolyzed, so that a compound where two $R_1$ are hydrogen atoms (hereinafter referred to as biscarbonyl intermediate (7a)) from among the biscarbonyl intermediates (hereinafter referred to as biscarbonyl intermediate (7)) which can be represented by general formula (7) can be obtained as deposit.

As the above described alkali, general alkaline agents, such as sodium hydroxide and potassium hydroxide, can be used. In addition, this alkali agent can be used in the form of a solution of approximately 1 N to 8 N.

In addition, conversion of the amine intermediate (6) to bisacyl can be achieved in accordance with, for example, a Friedel-Crafts reaction, which is well known to those skilled in the art. Concretely, this can be achieved by reacting the amine intermediate (6) with a Friedel-Crafts reagent in an appropriate solvent, and furthermore, hydrolyzing the product of reaction.

As the solvent used in this reaction, inactive solvents in which the amine intermediate (6) and the Friedel-Crafts reagent can be solved or dispersed can be used without any particular restrictions, and 1,2-dichloroethane and the like can be cited as examples. As the Friedel-Crafts reagent, reagents obtained by reacting an acyl halide compound, which can be represented by the following general formula, (hereinafter referred to as acyl halide compound) with a Lewis acid can be cited as examples.

$$X—CO—R_1$$

wherein $R_1$ is defined in the above described manner, and X is a halogen atom.

As the above described Lewis acid, aluminum chloride, antimony chloride, iron chloride, tin chloride and zinc chloride can be cited as examples. Though the amount of Lewis acid used is not particularly limited, 2.0 to 2.3 equivalents of the acyl halide compound and approximately 2.2 to 3.8 equivalents of the Lewis acid can be used for one equivalent of the amine intermediate (6), for example taking the efficiency of the reaction and the like into consideration.

The above described reaction can be conducted at a temperature from −40° C. to 80° C. for 2 hours to 8 hours, for example, while the mixture is being stirred.

After the completion of the reaction, the mixture can be hydrolyzed with an alkali in the same manner as in the case of the above described biscarbonyl intermediate (7a), and thus, a compound where two $R_1$ are groups other than hydrogen atoms from among biscarbonyl intermediates (7) (hereinafter referred to as biscarbonyl intermediate (7b)) can be obtained.

Furthermore, the biscarbonyl intermediate (7) is subjected to a Wittig-Horner reaction, so that an ether compound which can be represented by general formula (9a) or (9b) (hereinafter referred to as ether compound (9a) or (9b)) is obtained as a precursor of the asymmetric bishydroxy compound (1).

As the above described Wittig reagent, compounds which can be represented by the general formulas (8a) and (8b) (hereinafter referred to as Wittig reagent (8a) and (8b)) can be cited.

Here, the hydroxyl group in the substituent group represented by $Ar_4$ is protected by the substituent group $R_5$ in the Wittig reagent (8a) and (8b).

The biscarbonyl intermediate (7) and the Wittig reagent (8a) are made to react, and thereby, an ether compound (8a) is obtained, and furthermore, the protective group $R_5$ is deprotected, and thereby, a compound where n=0 in the asymmetric bishydroxy compound (1) (hereinafter referred to as asymmetric bishydroxy compound (1a)) is obtained.

In addition, the biscarbonyl intermediate (7) and the Wittig reagent (8b) are made to react, and thereby, an ether compound (9b) is obtained, and furthermore, the protective group $R_5$ is deprotected, and thereby, a compound where n=1 or 2 in the asymmetric bishydroxy compound (1) (hereinafter referred to as asymmetric bishydroxy compound (1b)) is obtained.

A Wittig-Horner reaction can be subjected within the biscarbonyl intermediate (7) in accordance with a method that is well known to those skilled in the art.

That is to say, the biscarbonyl intermediate (7) and the Wittig reagent (8a) or (8b) are made to react in an appropriate solvent in the presence of a basic catalyst, such as a metal alkoxide, and thereby, a target substance is obtained.

As the above described solvent, solvents which are inactive in terms of reaction and in which substances for reaction and the catalyst can be dissolved or dispersed can be used without any particular restrictions, and aromatic hydrocarbons, such as toluene and xylene, ethers, such as diethyl ether, tetrahydrofuran and ethylene glycol dimethyl ether, amides, such as N,N-dimethyl formamide, and sulfoxides, such as dimethyl sulfoxide, can be cited as examples, and these can be used alone or as a mixed solvent.

In addition, the amount of solvent used is not particularly limited, and an amount which is appropriate for allowing the reaction to progress smoothly can be selected in accordance with the conditions for reaction, for example the amount of the used substances for reaction, the temperature for reaction and the time for reaction.

As the above described metal alkoxide basic catalyst, well known alkali metal alkoxide bases, such as t-butoxide potassium, ethoxide sodium and methoxide sodium, for example, can be used. As the metal alkoxide bases, one type can be used alone, or two or more types can be used together.

Though the amount of substances for reaction and the catalyst are not particularly limited, and an appropriate amount can be selected from a wide range in accordance with the conditions for reaction, approximately 2.0 to 2.3 equivalents of the Wittig reagent (8a) or (8b) and approximately 2.0 to 2.5 equivalents of the catalyst can be used for one equivalent of the biscarbonyl intermediate (7), for example, taking smooth progress of the reaction into consideration.

This reaction can be conducted at room temperature or heating to 30° C. to 60° C. and for approximately 2 to 8 hours while the mixture is being stirred, and thus, an ether compound (9a) or (9b) can be obtained in accordance with a normal method.

Protection can be deprotected from the ether compound (9a) or (9b) in accordance with a well known method.

That is to say, this can be achieved by reacting the ether compound (9a) or (9b) with a deprotecting agent in an appropriate solvent.

As the above described deprotecting agent, well known agents, including hydrogen halides, such as hydrogen bromide and hydrogen iodide, aluminum halides, such as aluminum chloride and aluminum bromide, boron tribromide and sodium ethane thiol, for example, can be used.

As the deprotecting agent, one type from among the above described compounds can be used alone, or two or more types can be used together.

Though the amount of deprotecting agent used is not particularly limited, it is preferable to use approximately 2.0 to 3.0 equivalents for one equivalent of the ether compound (9a) or (9b), in order to make the reaction progress smoothly, and in order to make it possible to isolate and refine the target compound easily after the completion of the reaction, and it is more preferable to use approximately 2.2 to 2.6 equivalents.

As the above described solvent, solvents which are inert in a reaction and in which substances for reaction can be stably dissolved or dispersed can be used without any particular restrictions, and aromatic hydrocarbons, such as benzene and nitrobenzene, aromatic hydrocarbon halides, such as chlorobenzene, formamides, such as N,N-dimethyl formamide, acetic anhydride and methylene chloride, for example, are appropriate for use.

Here, an appropriate solvent can be selected for use from among the above described solvents in accordance with the type of deprotecting agent used.

In the case where a hydrogen halide is used, for example, acetic anhydride is preferable, and in the case where an aluminum halide is used, aromatic hydrocarbons, aromatic hydrocarbon halides and the like are preferable.

In addition, in the case where boron tribromide is used, methylene chloride is preferable, and in the case where sodium ethane thiol is used, formamide is preferable.

The amount of solvent used is not particularly limited, and an appropriate amount can be selected from a wide range in accordance with the conditions for reaction, for example the type, the amount for use and the temperature for reaction of the substances for reaction and the deprotecting agent.

This deprotection reaction can be subjected when the mixture is cooled or at room temperature in a state where the solvent is refluxed, and is completed in approximately 0.5 to 24 hours. Here, as the temperature for reaction, an appropriate temperature at which the deprotection reaction progresses smoothly can be selected. As a result of this reaction, an asymmetric bishydroxy compound (1) can be obtained.

The thus obtained asymmetric bishydroxy compound according to the present invention can be easily isolated and refined from the mixture that has reacted after the completion of reaction using a general refining means, such as extraction, chromatography, centrifugal separation, recrystallization or washing.

As concrete examples of the asymmetric bishydroxy compound (1), the examples shown in the following Table 1 can be cited.

TABLE 1
Exemplified Compounds
(1)
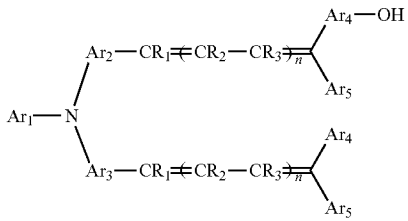
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 1 | 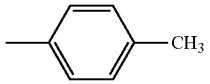 | 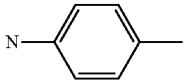 | 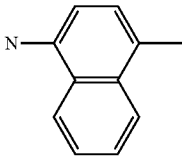 | H | 0 | — | 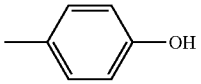 | H |
| 2 | 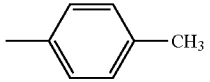 | 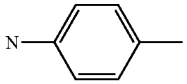 | 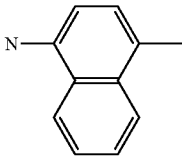 | H | 1 | =CH—CH= | 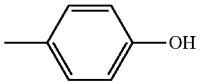 | H |
| 3 | 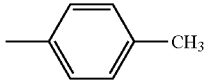 | 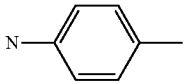 | 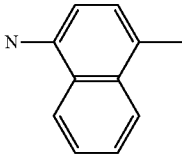 | H | 2 | =CH—CH=CH—CH= | 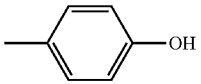 | H |
| 4 | 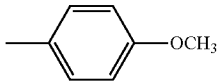 | 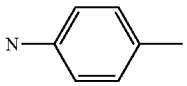 | 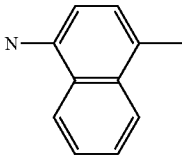 | H | 0 | — | 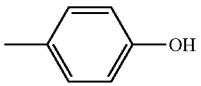 | H |

TABLE 1-continued
Exemplified Compounds
(1)
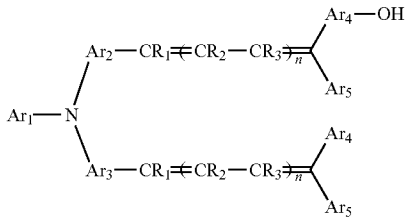
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 5 | 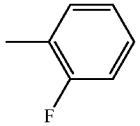 | 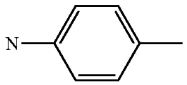 | 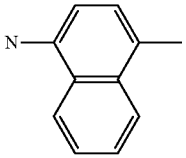 | H | 0 | — | 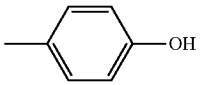 | H |
| 6 | 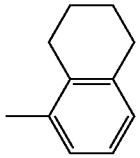 | 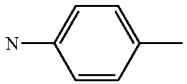 | 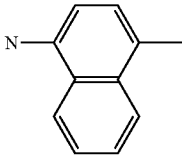 | H | 0 | — | 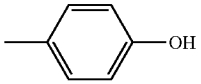 | H |
| 7 | 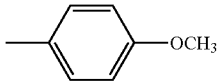 | 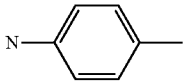 | 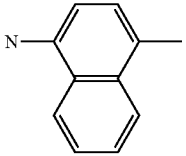 | H | 0 | =CH—CH= | 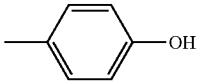 | H |
| 8 | 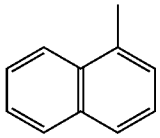 | 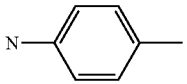 | 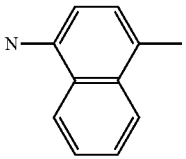 | H | 0 | — | 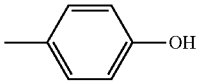 | H |

TABLE 1-continued
Exemplified Compounds
(1)
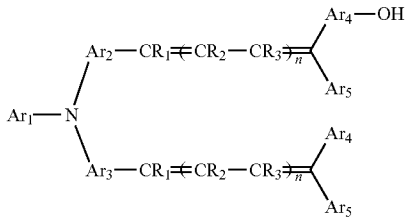
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 9 | 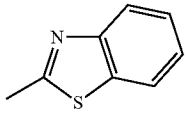 | 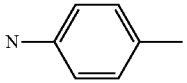 | 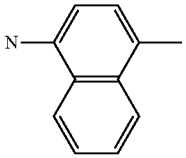 | H | 0 | — | 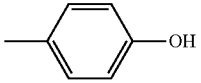 | H |
| 10 | 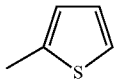 | 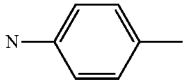 | 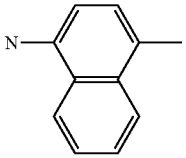 | H | 0 | — | 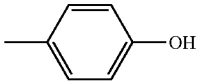 | H |
| 11 | 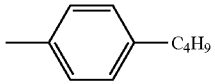 | 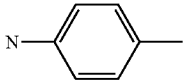 | 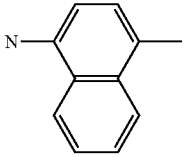 | H | 0 | — | 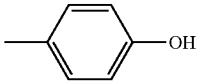 | $—CH_3$ |
| 12 | 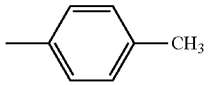 | 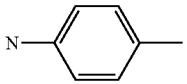 | 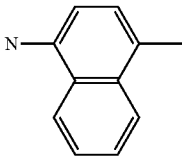 | H | 1 | =CH—CH= | 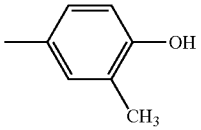 | $—CH_3$ |

TABLE 1-continued
Exemplified Compounds
(1)
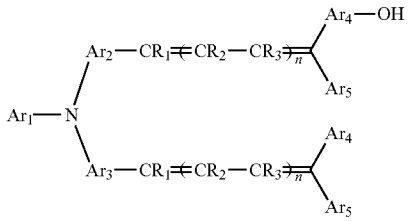
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 13 | 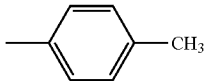 | 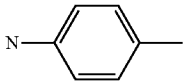 | 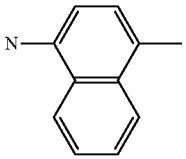 | H | 2 | =CH—CH=CH—CH= | 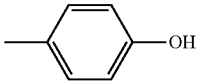 | —$CH_3$ |
| 14 | 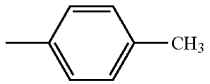 | 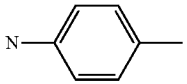 | 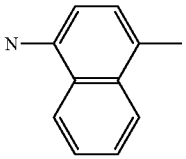 | H | 0 | — | 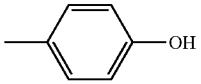 | 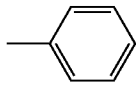 |
| 15 | 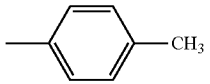 | 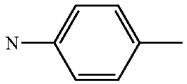 | 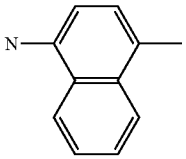 | —C2H5 | 0 | — | 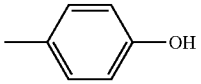 | H |
| 16 | 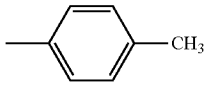 | 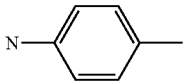 | 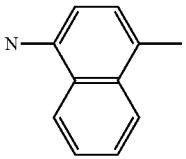 | —$CH_3$ | 0 | — | 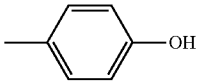 | H |

TABLE 1-continued
Exemplified Compounds
(1)
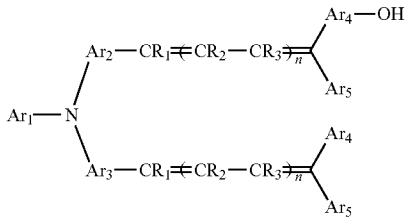
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 17 | 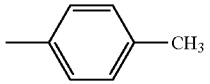 | 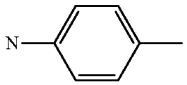 | 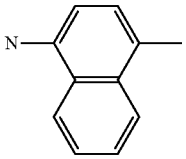 | $—CH_3$ | 1 | =CH—CH= | 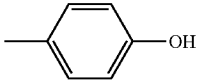 | H |
| 18 | 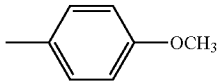 | 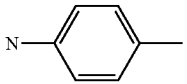 | 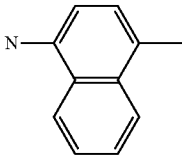 | H | 2 | =CH—CH=CH—CH= | 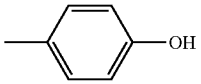 | H |
| 19 | 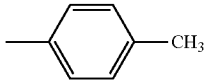 | 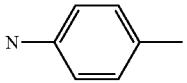 | 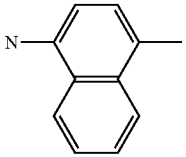 | $—CH_3$ | 0 | — | 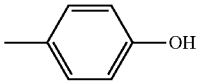 | $—CH_3$ |
| 20 | 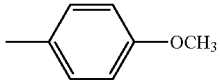 | 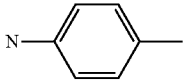 | 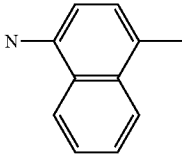 | H | 0 | — | 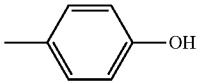 | $—CH_3$ |

TABLE 1-continued
Exemplified Compounds
(1)
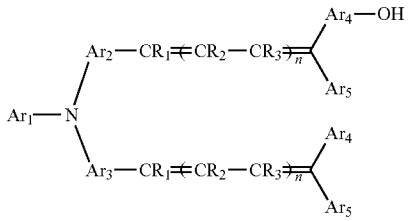
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 21 | 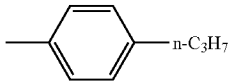 | 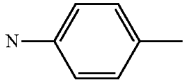 | 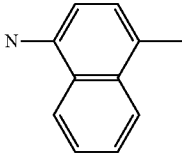 | $—CH_3$ | 1 | =CH—CH= | 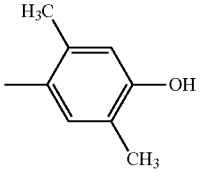 | $—CH_3$ |
| 22 | 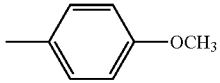 | 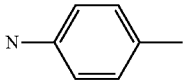 | 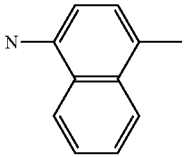 | H | 1 | =CH—CH= | 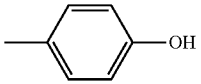 | $—CH_3$ |
| 23 | 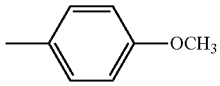 | 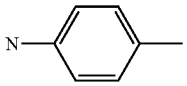 | 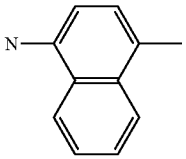 | H | 2 | =CH—CH=CH—CH= | 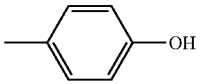 | $—CH_3$ |
| 24 | 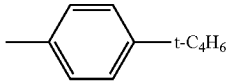 | 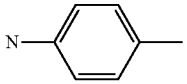 | 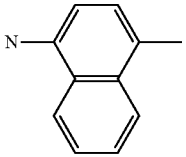 | $—CH_3$ | 1 | =CH—CH= | 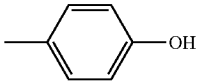 | 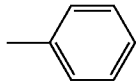 |

TABLE 1-continued
Exemplified Compounds
(1)
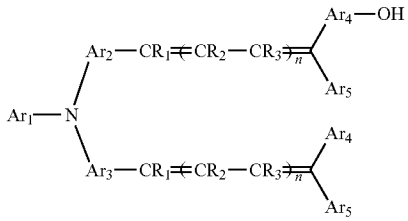
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 25 | 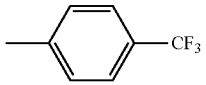 | 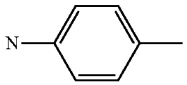 | 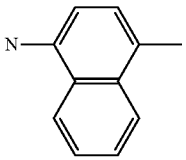 | —$CH_3$ | 1 | =CH—CH= | 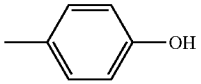 | H |
| 26 | 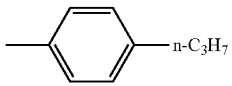 | 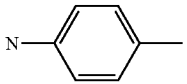 | 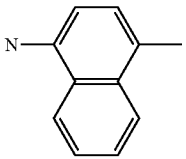 | 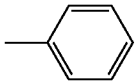 | 1 | =CH—CH= | 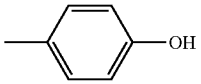 | —$CH_3$ |
| 27 | 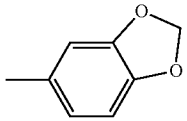 | 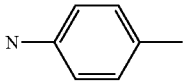 | 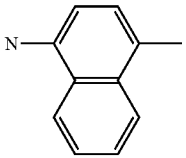 | 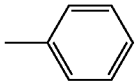 | 1 | =CH—CH= | 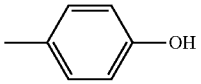 | 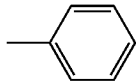 |
| 28 | 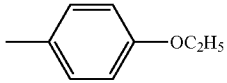 | 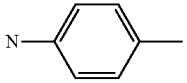 | 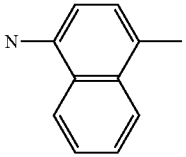 | 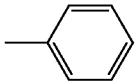 | 1 | =CH—CH= | 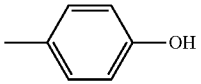 | H |

TABLE 1-continued
Exemplified Compounds
(1)
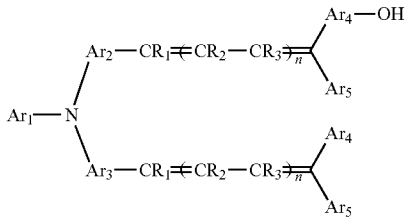
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 29 | 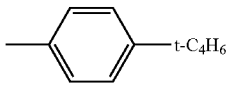 | 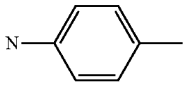 | 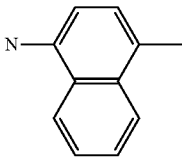 | H | 1 | =CH—CH= | 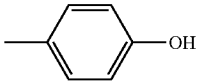 | 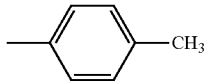 |
| 30 | 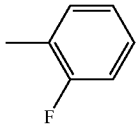 | 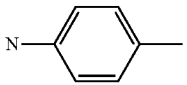 | 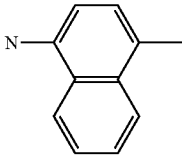 | H | 1 | =CH—CH= | 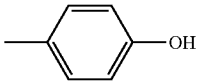 | H |
| 31 | 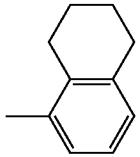 | 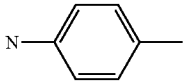 | 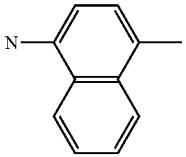 | H | 1 | =CH—CH= | 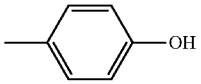 | 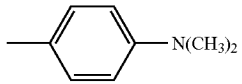 |
| 32 | 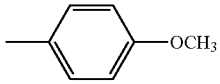 | 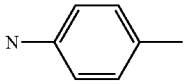 | 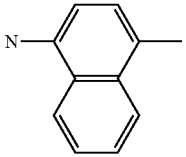 | H | 1 | =CH—CH= | 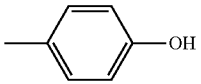 | 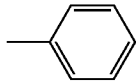 |

TABLE 1-continued
Exemplified Compounds
(1)
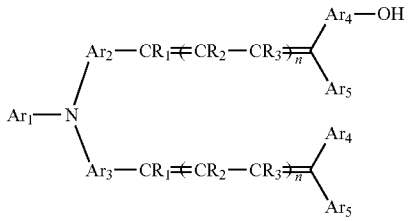
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 33 | 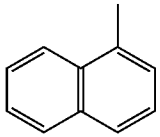 | 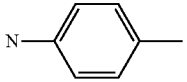 | 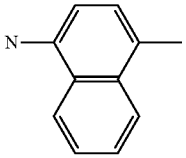 | H | 1 | =CH—CH= | 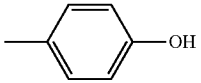 | 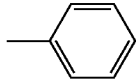 |
| 34 | 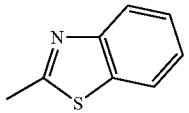 | 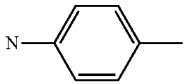 | 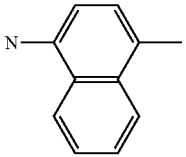 | —C2H5 | 1 | =CH—CH= | 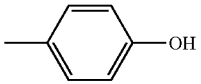 | H |
| 35 | 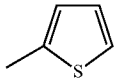 | 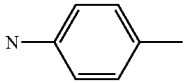 | 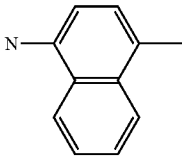 | 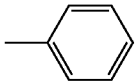 | 1 | =CH—CH= | 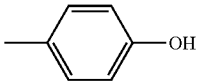 | H |
| 36 | 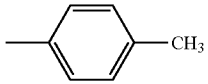 | 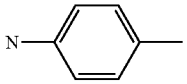 | 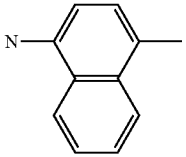 | H | 1 | 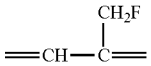 | 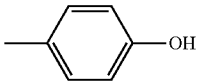 | H |

TABLE 1-continued
Exemplified Compounds
(1)
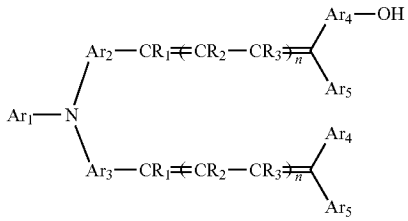
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 37 | 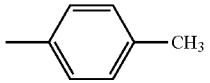 | 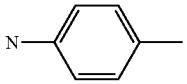 | 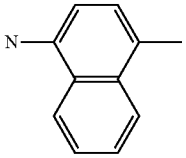 | H | 1 | 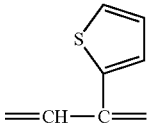 | 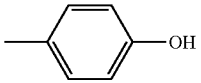 | H |
| 38 | 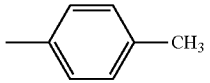 | 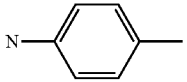 | 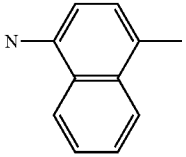 | H | 1 | 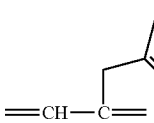 | 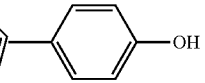 | H |
| 39 | 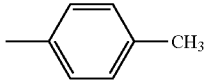 | 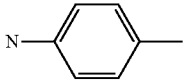 | 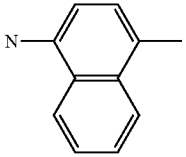 | H | 1 | 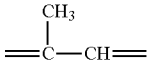 | 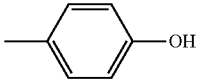 | H |
| 40 | 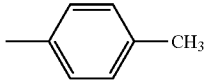 | 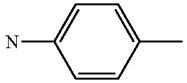 | 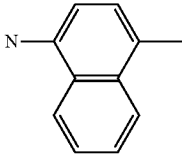 | 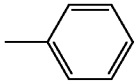 | 1 | 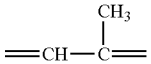 | 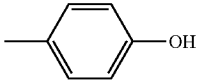 | H |

TABLE 1-continued
Exemplified Compounds
(1)
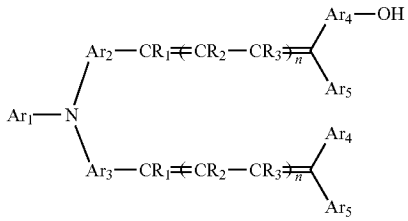
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 41 | 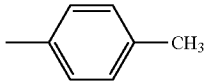 | 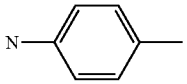 | 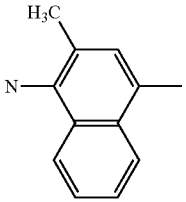 | H | 0 | — | 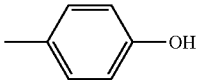 | H |
| 42 | 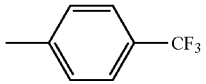 | 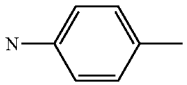 | 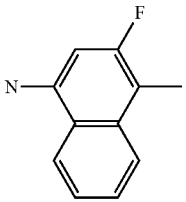 | H | 0 | — | 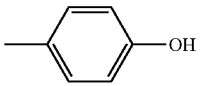 | H |
| 43 | 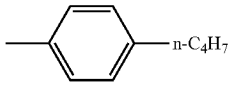 | 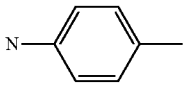 | 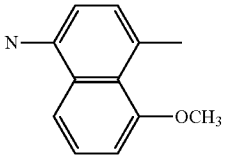 | H | 0 | — | 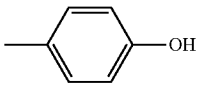 | —$CH_3$ |

TABLE 1-continued
Exemplified Compounds
(1)
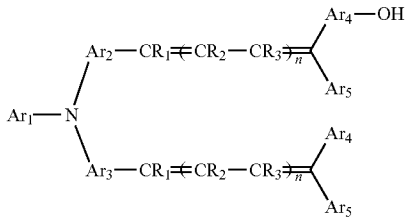
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 44 | 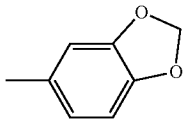 | 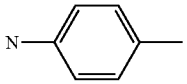 | 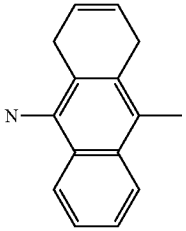 | H | 0 | — | 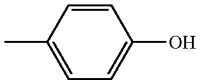 | |
| 45 | 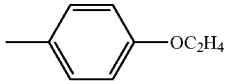 | 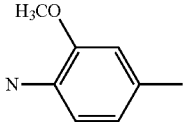 | 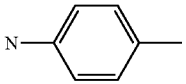 | H | 0 | — | 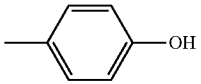 | —$CH_3$ |
| 46 | 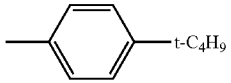 | 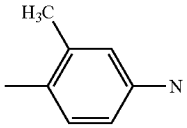 | 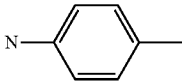 | H | 0 | — | 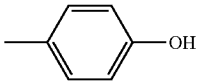 | —$CH_3$ |
| 47 | 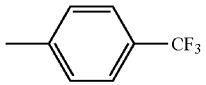 | 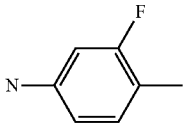 | 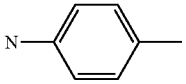 | H | 0 | — | 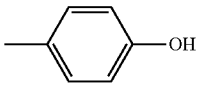 | H |

TABLE 1-continued
Exemplified Compounds
(1)
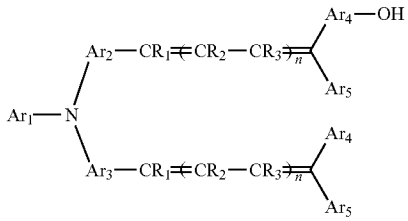
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 48 | 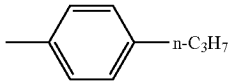 | 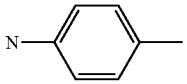 | 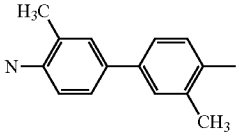 | H | 0 | — | 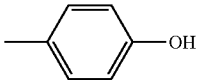 | 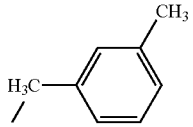 |
| 49 | 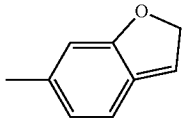 | 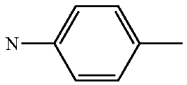 | 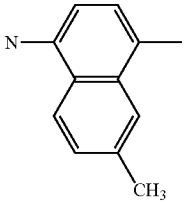 | H | 0 | — | 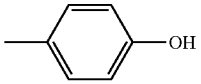 | 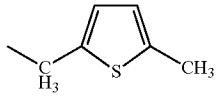 |
| 50 | 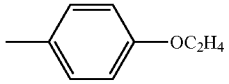 | 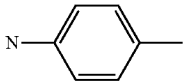 | 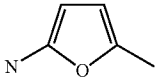 | H | 1 | =CH—CH= | 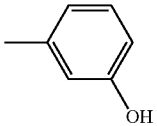 | 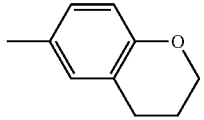 |
| 51 | 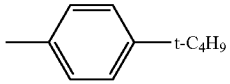 | 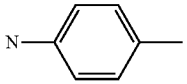 | 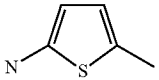 | H | 1 | =CH—CH= | 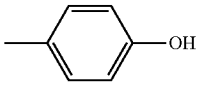 | H |

TABLE 1-continued
Exemplified Compounds
(1)
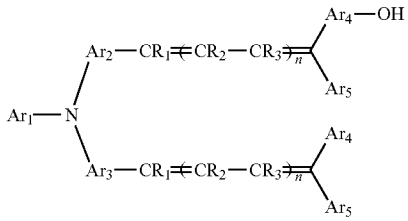
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 52 | 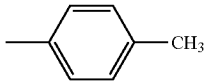 | 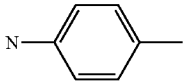 | 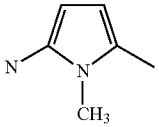 | H | 1 | =CH—CH= | 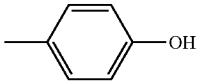 | H |
| 53 | 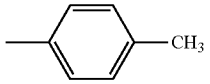 | 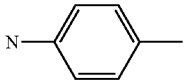 | 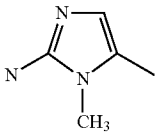 | H | 1 | =CH—CH= | 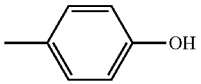 | H |
| 54 | 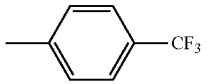 | 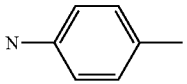 | 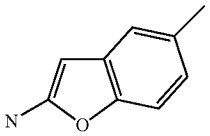 | iso-C3H7 | 1 | =CH—CH= | 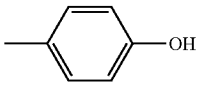 | H |
| 55 | 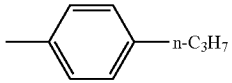 | 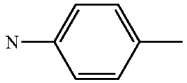 | 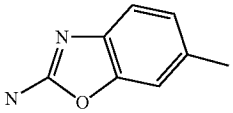 | H | 1 | =CH—CH= | 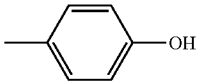 | H |

TABLE 1-continued
Exemplified Compounds
(1)
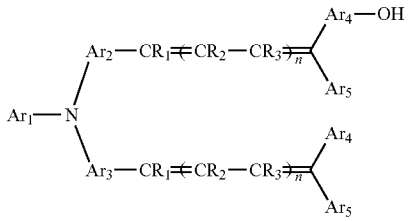
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 56 | 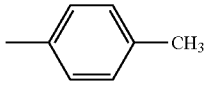 | 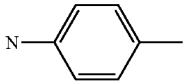 | 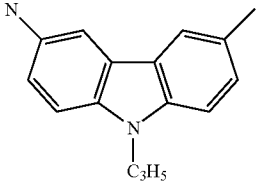 | n-C4H9 | 1 | =CH—CH= | 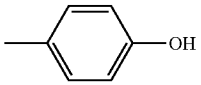 | H |
| 57 | 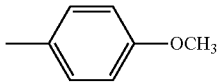 | 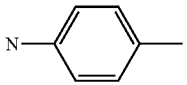 | 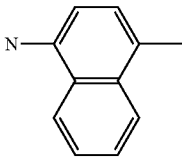 | H | 0 | — | 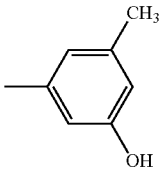 | —$CH_3$ |
| 58 | 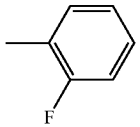 | 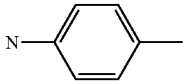 | 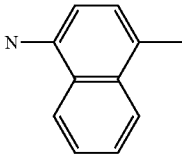 | H | 0 | — | 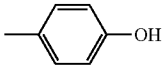 | H |

TABLE 1-continued
Exemplified Compounds
(1)
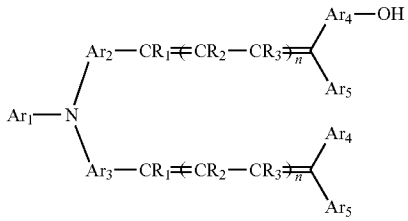
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 59 | 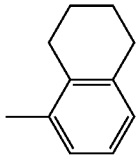 | 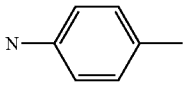 | 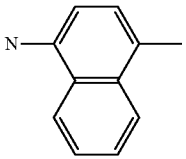 | H | 0 | — | 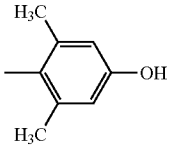 | H |
| 60 | 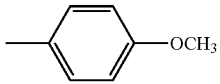 | 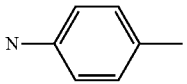 | 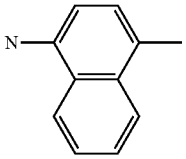 | H | 0 | — | 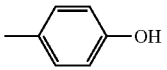 | —$CH_3$ |
| 61 | 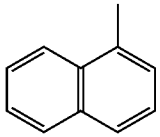 | 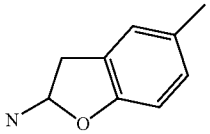 | 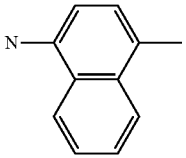 | H | 0 | — | 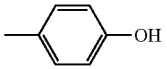 | —$CH_3$ |
| 62 | 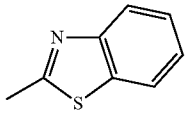 | 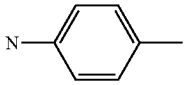 | 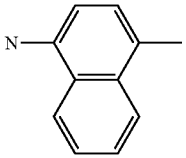 | H | 0 | — | 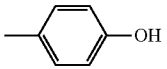 | —$CH_3$ |

TABLE 1-continued
Exemplified Compounds
(1)
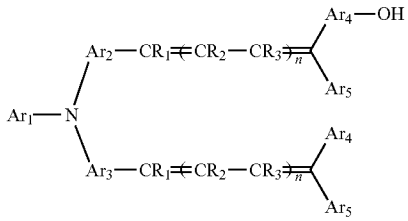
| No | $Ar^1$ | $Ar^2$ | $Ar^3$ | $R^1$ | n | =CR2—CR3= | $Ar^4$—OH | $Ar^5$ |
|---|---|---|---|---|---|---|---|---|
| 63 | 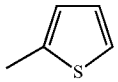 | 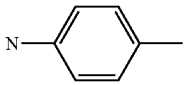 | 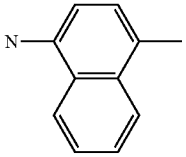 | H | 1 | =CH—CH= | 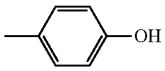 | H |
| 64 | 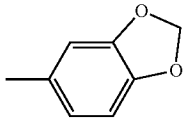 | 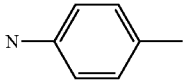 | 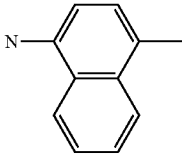 | H | 1 | =CH—CH= | 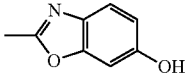 | H |
| 65 | 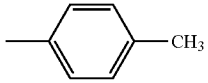 | 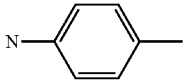 | 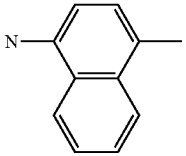 | $—CH_3$ | 1 | =CH—CH= | 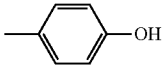 | H |

The asymmetric bishydroxy compounds according to the present invention have excellent charge transporting performance, as well as excellent solubility in solvents and compatibility with resins, and therefore, are useful as organic photoconductive materials, and in particular, are useful as charge transporting materials in the photosensitive layer of an electrophotoconductor or charge transporting materials in the surface protective layer.

In addition, the asymmetric bishydroxy compounds according to the present invention have two hydroxyl groups in a molecule, and therefore, are also useful as raw material compounds for a variety of polymer materials, particularly polymer materials derived from a compound having two hydroxyl groups.

An asymmetric bishydroxy compound according to the present invention can be used as, for example, a monomer for a polycarbonate resin; a polyether resin, a polyester resin, a polyurethane resin or the like, and thereby, a polymer photoconductive material which has excellent charge transporting performance and is useful as a photoconductive material can be obtained.

Polymer materials, such as polycarbonate resins, polyether resins, polyester resins and polyurethane resins, can be manufactured in accordance with the same conventional manufacturing method for the respective resins, except that one or more types of asymmetric bishydroxy compounds according to the present invention are used as a diol.

Polycarbonate resins, for example, can be manufactured in the same manner as conventional polycarbonate resins, except that one or more types of asymmetric bishydroxy compounds according to the present invention and one or more types of carbonate compounds are used as raw material compounds.

As the above described carbonate compounds, those which can be used for the manufacture of a polycarbonate resin can be used, and carbonyl compound halides, such as phosgene, bis(trichloromethyl)carbonate (also known as triphosgene), bisaryl carbonates, such as bisphenyl carbonate, and bisformate halides, such as bischloroformate, which is derived from a dihydroxy compound having two hydroxyl groups, can be cited as examples.

As the dihydroxy compounds which can be used as the material for a bisformate halide, 4,4'-(1-methylethylidene) bisphenol, 4,4'-(1-methylethylidene) bis(2-methyl phenol), 4,4'-cyclohexylidene bisphenol and 4,4-ethylidene bisphenol can be cited as examples.

Polymerization of an asymmetric bishydroxy compound and a carbonate compound according to the present invention can be carried out in accordance with a well known method. In the case where a carbonyl compound halide is used as the carbonate compound, for example, a polycarbonate resin can be obtained in accordance with a solution polymerization method, an interface polymerization method or the like.

In addition, in the case where bisaryl carbonate is used as the carbonate compound, a polycarbonate resin can be obtained in accordance with an ester exchanging method.

Asymmetric bishydroxy compounds according to the present invention have excellent solubility in solvents, and therefore, easily dissolve in the solvent used in the polymerization process.

Accordingly, the asymmetric bishydroxy compounds according to the present invention can be used as a raw material compound, and thus, polymerization reaction can progress smoothly, and a polymer material which is useful as a photoconductive material as described above can be easily obtained.

FIGS. 1 to 8 are cross sectional diagrams schematically showing the configuration of a main portion of an electrophotoconductor (hereinafter also simply referred to as "photoconductor") according to other embodiments of the present invention.

The electrophotographic sensitive bodies 11 to 14 shown in FIGS. 1 to 4 are single layer type electrophotographic sensitive bodies characterized in that the photosensitive layer 2 is a single layer type photosensitive layer 2 made of one layer.

In addition, the electrophotographic sensitive bodies 15 to 18 shown in FIGS. 5 to 8 are multilayer type electrophotographic sensitive bodies (hereinafter also referred to as "separated function type electrophotoconductor") characterized in that the photosensitive layer 7 is a multilayer type photosensitive layer (hereinafter also referred to as separated function type photosensitive layer) 7 made of a charge generating layer 3 and a charge transporting layer 4.

The electrophotoconductor 11 shown in FIG. 1 includes a conductive support (tube for electrophotoconductor) 1 and a photosensitive layer 2 formed on the surface of the conductive support 1.

Figure 2:
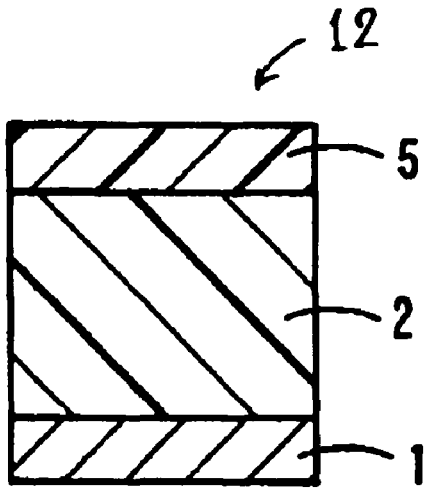
FIG. 2 is a cross sectional diagram schematically showing the configuration of a main portion of a single layer type electrophotoconductor 12 according to another embodiment of the present invention.

The electrophotoconductor 12 shown in FIG. 2 includes a conductive support 1, a photosensitive layer 2 formed on the surface of the conductive support 1 and a surface protective layer 5 formed on the surface of the photosensitive layer 2.

Figure 3:
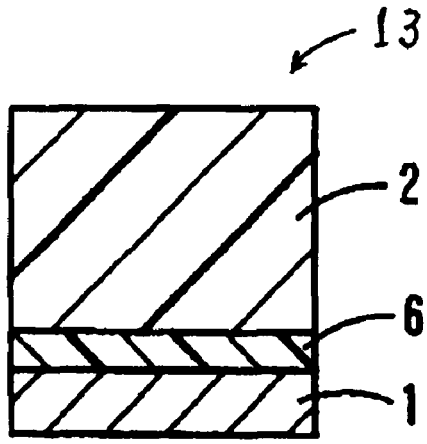
FIG. 3 is a cross sectional diagram schematically showing the configuration of a main portion of a single layer type electrophotoconductor 13 according to another embodiment of the present invention.

The electrophotoconductor 13 shown in FIG. 3 includes a conductive support 1, an intermediate layer 6 formed on the surface of the conductive support 1 and a photosensitive layer 2 formed on the surface of the intermediate layer 6.

Figure 4:
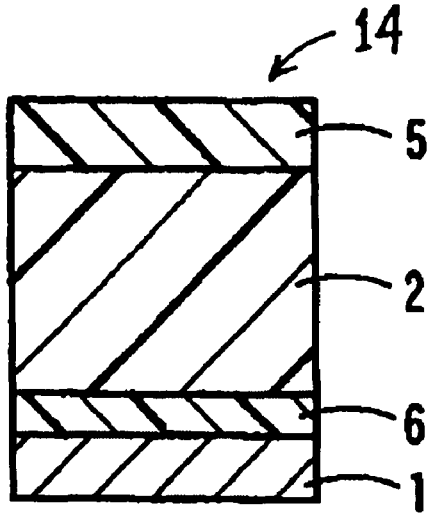
FIG. 4 is a cross sectional diagram schematically showing the configuration of a main portion of a single layer type electrophotoconductor 14 according to another embodiment of the present invention.

The electrophotoconductor 14 shown in FIG. 4 includes a conductive support 1, an intermediate layer 6 formed on the surface of the conductive support 1, a photosensitive layer 2 formed on the surface of the intermediate layer 6 and a surface protective layer 5 formed on the surface of the photosensitive layer 2.

Figure 5:
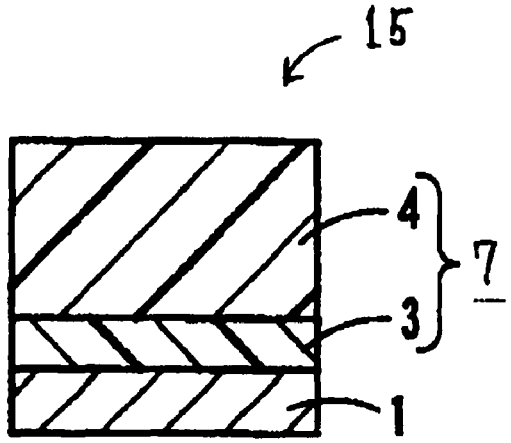
FIG. 5 is a cross sectional diagram schematically showing the configuration of a main portion of a multilayer type electrophotoconductor 15 according to another embodiment of the present invention.

The electrophotoconductor 15 shown in FIG. 5 includes a conductive support 1, a charge generating layer 3 formed on the surface of the conductive support 1 and a charge transporting layer 4 formed on the surface of the charge generating layer 3.

Figure 6:
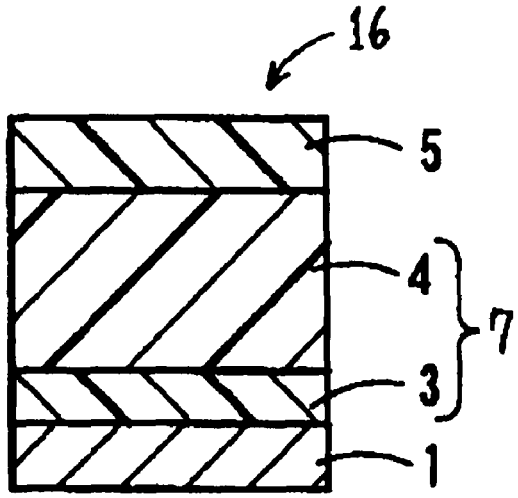
FIG. 6 is a cross sectional diagram schematically showing the configuration of a main portion of a multilayer type electrophotoconductor 16 according to another embodiment of the present invention.

The electrophotoconductor 16 shown in FIG. 6 includes a conductive support 1, a charge generating layer 3 formed on the surface of the conductive support 1, a charge transporting layer 4 formed on the surface of the charge generating layer 3 and a surface protective layer 5 formed on the surface of the charge transporting layer 4.

Figure 7:
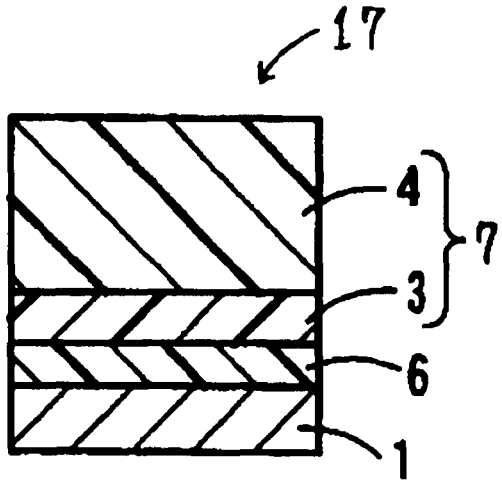
FIG. 7 is a cross sectional diagram schematically showing the configuration of a main portion of a multilayer type electrophotoconductor 17 according to another embodiment of the present invention.

The electrophotoconductor 17 shown in FIG. 7 includes a conductive support 1, an intermediate layer 6 formed on the surface of the conductive support 1, a charge generating layer 3 formed on the surface of the intermediate layer 6 and a charge transporting layer 4 formed on the surface of the charge generating layer 3.

Figure 8:
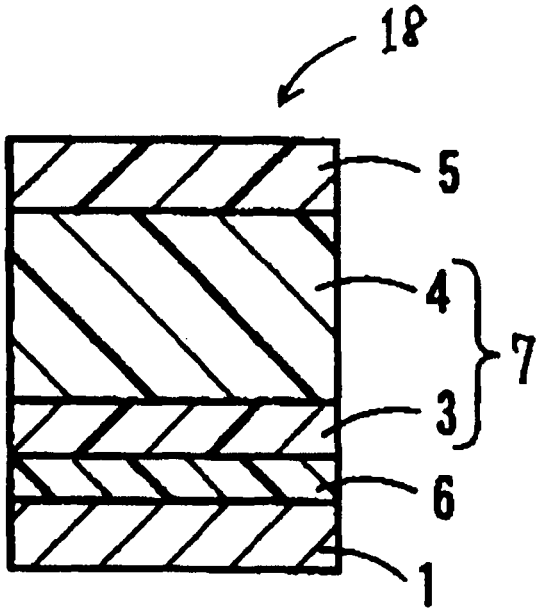
FIG. 8 is a cross sectional diagram schematically showing the configuration of a main portion of a multilayer type electrophotoconductor 18 according to another embodiment of the present invention.

The electrophotoconductor 18 shown in FIG. 8 includes a conductive support 1, an intermediate layer 6 formed on the surface of the conductive support 1, a charge generating layer 3 formed on the surface of the intermediate layer 6, a charge transporting layer 4 formed on the surface of the charge generating layer 3 and a surface protective layer 5 formed on the surface of the charge transporting layer 4.

The respective layers forming the electrophotographic sensitive bodies 11 to 18 shown in FIGS. 1 to 8 are concretely described in the following.

Conductive Support

The conductive support 1 is formed of a metal material, for example aluminum, an aluminum alloy, copper, zinc, stainless steel, titanium or the like. In addition, the conductive support is not limited to any of these metal materials, and bases made of polymer materials, such as polyethylene terephthalate, polyamide, polyester, polyoxymethylene and polystyrene, hard paper, glass or the like on the surface of which a metal foil is laminated, a metal material is deposited or a layer of a conductive compound, such as a conductive polymer, tin oxide or indium oxide, is deposited or applied, can also be used.

Though the conductive support 1 in the sensitive bodies 11 to 18 shown in FIGS. 1 to 8 is in sheet form, the form of the conductive support is not limited to this, and the conductive support may be in cylindrical form, columnar form, the form of a belt without ends or the like.

A process for coating through anodic oxidation, a surface process using chemicals, hot water or the like, a coloring process, a process for diffuse reflection, such as surface roughening, or the like may be carried out on the surface of the conductive support 1 if necessary, within such a range as not to affect the image quality.

The process for diffusion reflection is particularly effective in the case where an electrophotoconductor according to the present invention is used in an electrophotographic process using a laser as the light source for exposure to light. That is to say, in the electrophotographic process using a laser as the light source for exposure to light, the wavelength of the laser beam is coherent, and therefore, the laser beam reflected from the surface of the electrophotoconductor and the laser beam reflected from the inside of the electrophotoconductor interfere with each other, and the interference pattern caused by this interference may appear in the image, causing image defects.

However, a process for diffusion reflection is carried out on the surface of the conductive support 1 as described above, and thereby, such image defects caused by interference between the laser beams of which the wavelength is coherent can be prevented.

Single Layer Type Photosensitive Layer

The photosensitive layer 2, which is a single layer type photosensitive layer, is formed so as to include a charge generating substance, an asymmetric bishydroxy compound according to the present invention and a binder resin. In the photosensitive layer 2, the asymmetric bishydroxy compound according to the present invention functions as a charge transporting substance. The photosensitive layer 2 may contain a charge transporting substance other than the asymmetric bishydroxy compound according to the present invention, an additive, such as an antioxidant, or the like if necessary.

The above described charge generating substance is a substance which generates a charge by absorbing light. As the charge generating substance, those commonly used in this field can be used, and organic pigments and dyes, such as azo based pigments (monoazo based pigments, bisazo based pigments, trisazo based pigments and the like), indigo based pigments (indigo, thioindigo and the like), perylene based pigments (perylene imide, perylenic anhydride and the like), polycyclic quinone based pigments (antraquinone, pyrenquinone and the like), phthalocyanine based pigments (metal phthalocyanine, non-metal phthalocyanine and the like), squarylium coloring, pyrylium salts, thiopyrylium salts and triphenylmethane based coloring, and inorganic materials, such as selenium and amorphous silicon can be cited as examples.

One type from among the above described charge generating substances can be used alone, or two or more types can be combined for use.

From among these charge generating substances, X type non-metallic phthalocyanine and metal phthalocyanine are preferable, and oxotitanium phthalocyanine is more preferable.

X type non-metal phthalocyanine and metal phthalocyanine, particularly oxotitanium phthalocyanine, have high charge generation efficiency and charge injection efficiency, and therefore, generate a large amount of charge by absorbing light, and inject the generated charge efficiently into the asymmetric bishydroxy compound according to the present invention, which is a charge transporting substance contained in the photosensitive layer 2 or 7, without storing the generated charge within the molecules.

Accordingly, charge that is generated in the charge generating substance through light absorption is efficiently injected into the asymmetric bishydroxy compound according to the present invention, which is used as a charge transporting substance, so as to be transported smoothly, and therefore, a highly sensitive electrophotoconductor with high resolution can be obtained.

The charge generating substance may be combined for use with a sensitizing dye, for example a triphenyl methane based dye, such as methyl violet, crystal violet, night blue, Victoria blue or the like, an acridine dye, such as erythrocine, rhodamine B, rhodamine 3R, acridine orange, flapeocine or the like, a thiazine dye, such as methylene blue or methylene green, an oxadine dye, such as capri blue, meldra blue or the like, a thiamine dye, a styryl dye, a pyrylium salt dye or a thiopyrylium salt dye.

As the asymmetric bishydroxy compound according to the present invention, which is used as a charge transporting substance, one or more types selected from the above described asymmetric bishydroxy compounds (1) can be used.

A charge transporting substance other than the asymmetric bishydroxy compound according to the present invention, for example, can be used in order to further enhance the electrical properties of the photosensitive layer 2.

Such charge transporting substances includes a hole transporting substances and electron transporting substances.

As the above described hole transporting substance, hole transporting substances commonly used in this field can be used, and carbazole derivatives, pyrene derivatives, oxazole derivatives, oxadiazole derivatives, thiazole derivatives, thiadiazole derivatives, triazole derivatives, imidazole derivatives, imidazolon derivatives, imidazolidine derivatives, bisimidazolidine derivatives, styryl compounds, hydrazone compounds, polycyclic aromatic compounds, indole derivatives, pyrazoline derivatives, oxazolon derivatives, benzimidazole derivatives, quinazoline derivatives, benzofuran derivatives, acridine derivatives, phenazine derivatives, amino stilbene derivatives, triaryl amine derivatives, triaryl methane derivatives, phenylenediamine derivatives, stilbene derivatives, enamine derivatives, benzidine derivatives, polymers having a group derived from any of these compounds in the main chain or in a branch chain (poly-N-vinyl carbazole, poly-1-vinyl pyrene, ethyl carbazole-formaldehyde resins, triphenyl methane polymers, poly-9-vinyl anthracene and the like) and polysilane can be cited as examples.

In addition, as the above described electron transporting substance, electron transporting substances commonly used in this field can be used, and organic compounds, such as benzoquinone derivatives, tetracyanoethylene derivatives, tetracyanoquinodimethane derivatives, fluorenone derivatives, xanthon derivatives, phenanthraquinone derivatives, phthalic anhydride derivatives and diphenoquinone derivatives, and inorganic materials, such as amorphous silicon, amorphous selenium, tellurium, selenium-tellurium alloys, cadmium sulfide, antimony sulfide, zinc oxide and zinc sulfide, can be cited as examples. One type from among these electron transporting substances can be used alone, or two or more type can be combined for use.

As the above described binder resin, resins having binding properties are used, for example, for the purpose of increasing the physical strength, the durability and the like of the photosensitive layer 2.

As the binder resin, resins having excellent compatibility with the asymmetric bishydroxy compound according to the present invention are preferably used.

As concrete examples of this resin, vinyl based resins, such as polymethyl methacrylate, polystyrene and polyvinyl chloride, thermoplastic resins, such as polycarbonate, polyester, polyester carbonate, polysulfone, polyarylate, polyamide, methacrylic resins, acrylic resins, polyether, polyacrylamide and polyphenylene oxide, thermosetting resins, such as phenoxy resins, epoxy resins, silicone resins, polyurethane and phenol resins, and partially cross linking resins of these can be cited.

From among the above described resins, polystyrene, polycarbonate, polyarylate and polyphenylene oxide have particularly excellent compatibility with the asymmetric bishydroxy compound according to the present invention, as well as excellent electrically insulating properties, such that the volume resistance value is no less than $10^{13}$ O, in addition to excellent film forming properties and potential properties, and therefore, are appropriate for use as a binder resin, and polycarbonate is particularly appropriate for use. One type can be used alone as the binder resin, or two or more types can be combined for use.

Though the ratio for use of the asymmetric bishydroxy compound according to the present invention to the binder resin is not particularly limited, it is preferable to use 100 weight parts to 2000 weight parts of the binder resin relative to 100 weight parts of the asymmetric bishydroxy compound according to the present invention in the case of use for the surface protective layer.

In the case where the amount of binder resin used relative to 100 weight parts of the asymmetric bishydroxy compound according to the present invention is less than 100 weight parts, the degree of wear increases, and the surface protective layer sometimes fails to work as a protective layer.

Meanwhile, in the case where the amount of this binder resin used exceeds 2000 weight parts, the amount ratio of the binder resin relative to the charge transporting substance becomes high, and such a phenomenon that the sensitivity lowers can be observed.

In the case where the binder resin is used for the charge transporting layer, it is preferable to use 50 weight parts to 300 parts of the binder resin relative to 100 weight-parts of the asymmetric bishydroxy compound according to the present invention.

In the case where the amount of binder resin used relative to 100 weight parts of the asymmetric bishydroxy compound according to the present invention is less than 50 weight parts, the degree of wear becomes high, while in the case where the amount of binder resin used exceeds 300 weight parts, it was perceived that the sensitivity lowered.

Antioxidants reduce deterioration of the surface layer due to the attachment of an active substance, such as ozone, NOx and the like, which are generated at the time of charge of the electrophotoconductor, and in addition, can increase the durability when the electrophotoconductor is repeatedly used. Furthermore, antioxidants increase the stability of the application liquid for the formation of a photosensitive layer, as described below, so that the life of the liquid is extended, and the durability of the electrophotoconductor that has been manufactured using this application liquid also increases, due to the reduction of impurities having oxidizing properties.

As the above described antioxidant, hindered phenol derivatives, hindered amine derivatives and the like can be cited as examples.

Though the amount of antioxidant used is not particularly limited, it is preferable for it to be 0.1 weight parts to 10 weight parts relative to 100 weight parts of the charge transporting substance. In the case where the amount of antioxidant used is less than 0.1 weight parts, the effects of increasing the stability of the below described application liquid for the formation of a photosensitive layer and the durability of the electrophotoconductor become insufficient, while in the case where it exceeds 10 weight parts, the electrical properties of the electrophotoconductor are negatively affected.

The photosensitive layer 2 can be formed in such a manner that an application liquid for the formation of a photosensitive layer is prepared by dissolving or dispersing a charge generating substance, an asymmetric bishydroxy compound according to the present invention, a binder resin and, if necessary, a charge transporting substance other than the asymmetric bishydroxy compound according to the present invention and antioxidant in an appropriate organic solvent, and this application liquid is applied to the surface of the conductive support 1 or the above described intermediate layer 6 and then dried, so that the organic solvent is removed.

The asymmetric bishydroxy compound according to the present invention has excellent solubility in the solvent and compatibility with the binder resin, and therefore, dissolves or disperses uniformly in the application liquid, and furthermore, does not crystallize during the process of forming the photosensitive layer 2.

Accordingly, a uniform photosensitive layer 2 having no crystallized portions can be formed according to the present invention.

As the above described organic solvent, aromatic hydrocarbons, such as benzene, toluene, xylene, mesitylene, tetralin, diphenylmethane, dimethoxybenzene and dichlorobenzene, hydrocarbon halides, such as dichloromethane and dichloroethane, ethers, such as tetrahydrofuran (THF), dioxane, dibenzyl ether and dimethoxymethyl ether, ketones, such as cyclohexanone, acetophenone and isophorone, esters, such as benzoate and ethyl acetate, sulfur containing solvents, such as diphenyl sulfide, fluorine based solvents, such as hexafluoroisopropanol, and aprotic polar solvents, such as N,N-dimethyl formamide, can be cited as examples, and one type from among these solvents can be used alone, or a mixture solvent of two or more types can be used, and furthermore, a mixed solvent obtained by adding an alcohol, acetonitrile or methyl ethyl ketone to one type from among these solvents or a mixed liquid of two or more types can also be used.

Though the film thickness of the photosensitive layer is not particularly limited, it is preferably 5 μm to 100 μm, and it is more preferably 10 μm to 50 μm. In the case where the film thickness is less than 5 μm, there is a risk that the charge holding performance on the surface of the electrophotoconductor may lower, and conversely, in the case where the film thickness exceeds 100 μm, there is a risk that the productivity of the electrophotoconductor may lower.

Multilayer Type Photosensitive Layer

The photosensitive layer 7, which is a multilayer type photosensitive layer, is a layered body formed so as to include a charge generating layer 3 and a charge transporting layer 4.

Charge Generating Layer

The charge generating layer 3 contains a charge generating substance and a binder resin.

As the charge generating substance, one or more types of charge generating substances which are similar to that included in photosensitive layer 2 can be used.

As the binder resin, resins which are conventionally used as the matrix resin in the charge generating layer and thermoplastic resins, such as polyester, polystyrene, acrylic resins, methacrylic resins, polycarbonate and polyarylate, thermosetting resins, such as polyurethane, phenol resins, alkyd resins, melamine resins, epoxy resins, silicone resins, phenoxy resins, polyvinyl butyral, polyvinyl formal, and copolymer resins which contain two or more of the component units included in these resins (insulating resins, such as vinyl chloride-vinyl acetate copolymer resins, vinyl chloride-vinyl acetate-maleic anhydride copolymer resins and acrylonitrile-styrene copolymer resins) can be cited as examples. From among these, polyvinyl butyral is preferable. One type of binder resin can be used alone or two or more types can be used together.

Though the content ratio of the charge generating substance to the binder resin is not particularly limited, preferably, 10 wt % to 99 wt % of the charge generating substance is contained in the entirety of the total amount of the charge generating substance and the binder resin, and the remaining portion is the binder resin.

In the case where the ratio of the charge generating substance is less than 10 wt %, there is a risk that the sensitivity may lower, and conversely, in the case where the ratio of the charge generating substance exceeds 99 wt %, the strength of the film of the charge generating layer 3 is reduced, and in addition, the level of the dispersion of the charge generating substance lowers, and thus, the number of coarse particles increase in such a manner that the charge on the surface, excluding the portions to be erased through exposure to light, is reduced, and therefore, a great number of image defects, in particular, overlapping of images, which are referred to as black spots where microscopic black dots are formed of the toner attached to a white background, are generated.

The charge generating layer 3 may include an appropriate amount of each of one or more types selected from among a hole transporting material, an electron transporting material, an antioxidant, a dispersion stabilizer and a sensitizer, if necessary, in addition to the above described two types of essential components. As a result, the potential properties are increased and the stability of the below described application liquid for the formation of a charge generating layer is increased, and thus, the deterioration resulting from fatigue when the electrophotoconductor is repeatedly used is alleviated and the durability can be increased.

The above described charge generating layer 3 can be formed in such a manner that a charge generating substance, a binder resin and other additives, if necessary, are dissolved or dispersed in an appropriate organic solvent, for example, and thereby, an application liquid for the formation of a charge generating layer is prepared, and this application liquid is applied to the surface of the conductive support 1 or the below described intermediate layer 6 and then dried so that the organic solvent is removed. Concretely, a charge generating substance and other additives, if necessary, are dissolved or dispersed, for example, in a resin solution where a binder resin is dissolved in an organic solvent, and thereby, an application liquid for the formation of a charge generating layer is prepared.

As the organic solvent used here, hydrocarbon halides, such as tetrachloropropane and dichloroethane, ketones, such as isophorone, methyl ethyl ketone, acetophenone and cyclohexanone, esters, such as ethyl acetate, methyl benzoate and butyl acetate, ethers, such as tetrahydrofuran (THF), dioxane, dibenzyl ether, 1,2-dimethoxy ethane and dioxane, aromatic hydrocarbons, such as benzene, toluene, xylene, mesitylene, tetralin, diphenylmethane, dimethoxybenzene and dichlorobenzene, sulfur containing solvents, such as diphenyl sulfide, fluorine based solvents, such as hexafluoroisopropanol, and aprotic polar solvents, such as N,N-dimethyl formamide, N,N-dimethyl acetamide can be cited as examples. In addition, these solvents can be used solely or a mixed solvent where two or more types are mixed can be used.

Prior to dissolving or dispersing a charge generating substance and the like in a resin solution, the charge generating substance and the other additives may be crushed in advance.

Crushing is carried out in advance using a general crushing machine, such as a ball mill, a sand mill, an attritor, a vibration mill or an ultrasonic dispersing machine.

The dissolving or dispersing of the charge generating substance and the like in the resin solution is carried out using a general dispersing machine, such as a paint shaker, a ball mill or a sand mill. At this time, it is preferable to select appropriate conditions for dispersion so that no impurities are generated through friction or the like from a member, which forms a container and a dispersing machine containing the resin solution, the charge generating substance and the like, and mixed into the application liquid.

As the method for applying the application liquid for the formation of a charge generating layer, a roll application, a spray application, a blade application, a ring application, a submerging application and the like can be cited.

Though the film thickness of the charge generating layer 3 is not particularly limited, it is preferably 0.05 μm to 5 μm, and it is more preferably 0.1 μm to 1 μm. This is because in the case where the film thickness of the charge generating layer is less than 0.05 μm, the efficiency of light absorption is reduced, and thus, the sensitivity is lowered, and contrarily, in the case where the film thickness of the charge generating layer exceeds 5 μm, the charge transfer inside the charge generating layer becomes the rate determining step in the process of erasing the charge on the surface of the electrophotoconductor, and thus, the sensitivity is lowered.

Charge Transporting Layer

The charge transporting layer 4 contains an asymmetric bishydroxy compound according to the present invention, which has an ability of accepting and transporting charge that has been generated in the charge generating substance, and a binder resin. Furthermore, the charge transporting layer 4 can include a charge transporting substance other than the asymmetric bishydroxy compound according to the present invention, and additives, such as an antioxidant, if necessary.

As the asymmetric bishydroxy compound according to the present invention, one or more types selected from among the above described asymmetric bishydroxy compounds (1) can be used.

In addition, as the charge transporting substance other than the asymmetric bishydroxy compound according to the present invention, the binder resin and the antioxidant, similar amounts of components, which are the same as those used in the photosensitive layer 2, can be used, respectively.

The charge transporting layer 4 can be formed in such a manner that an asymmetric bishydroxy compound according to the present invention, a binder resin and, if necessary, a charge transporting substance other than the asymmetric bishydroxy compound according to the present invention, and an antioxidant, for example, are dissolved and dispersed in an appropriate organic solvent, and thus, an application liquid for the formation of a charge transporting layer is prepared, and this application liquid for the formation of a charge transporting layer is applied to the surface of the charge generating layer 3 and then dried so that the organic solvent is removed.

No crystallization of the asymmetric bishydroxy compound according to the present invention occurs even during the process of forming the charge transporting layer 4, and therefore, a charge transporting layer 4 where the asymmetric bishydroxy compound according to the present invention is uniformly dispersed can be formed.

As the organic solvent used here, the same organic solvent as that used for the formation of the photosensitive layer 2 can be used.

The method for applying the application liquid for the formation of a charge transporting layer to the surface of the charge generating layer 3 is not particularly limited, and a submerging application, a roll application and an ink jet application can be cited as examples. In addition, drying is carried out by selecting an appropriate temperature so that the organic solvent contained in the application liquid is removed, and a charge transporting layer 4 having a uniform surface can be formed.

Though the film thickness of the charge transporting layer 4 is not particularly limited, it is preferably 5 μm to 50 μm, and it is more preferably 10 μm to 40 μm. This is because in the case where the film thickness of the charge transporting layer is less than 5 μm, there is a risk that the ability of holding charge on the surface of the electrophotoconductor may be reduced, and contrarily, in the case where the film thickness of the charge transporting layer exceeds 50 μm, there is a risk that the resolution of the electrophotoconductor may be lowered.

Surface Protective Layer

The surface protective layer 5 has a function of increasing the durability of the electrophotoconductor. The surface protective layer 5 contains an asymmetric bishydroxy compound according to the present invention and a binder resin. Furthermore, the surface protective layer 5 may include a charge transporting substance other than the asymmetric bishydroxy compound according to the present invention, if necessary.

As the asymmetric bishydroxy compound according to the present invention, one or more types selected from among the above described asymmetric bishydroxy compounds (1) can be used. In addition, as the charge transporting substance other than the asymmetric bishydroxy compound according to the present invention and the binder resin, similar amounts of components, which are the same as those used in the photosensitive layer 2, can be used, respectively.

As the charge transporting substance contained in the photosensitive layer 2 or the charge transporting layer 4 in the electrophotoconductor where a surface protective layer 5 is provided, a butadiene compound is preferable. A potential barrier can be prevented from being formed on the interface between the photosensitive layer 2 or the charge transporting layer 4 and the surface protective layer 5 by using a butadiene compound, and therefore, the transferring and receiving of charge between the surface protective layer 5 and the photosensitive layer 2 or the charge transporting layer 4 are made smooth so that the sensitivity and response to light of the photoconductor can be increased.

Here, as the charge transporting substance contained in the photosensitive layer 2 or the charge transporting layer 4 in the electrophotoconductor where a surface protective layer 5 is provided, an asymmetric bishydroxy compound according to the present invention may be used. The asymmetric bishydroxy compound according to the present invention has a partial structure which is similar to that of a butadiene compound, and therefore, the transferring and receiving of charge between the photosensitive layer 2 or the charge transporting layer 4 and the surface protective layer 5 are made smooth in the same manner as in the case where a butadiene compound is used by using an asymmetric bishydroxy compound according to the present invention, and thus, the sensitivity and response to light in the photoconductor can be increased.

The surface protective layer 5 can be formed in such a manner that an asymmetric bishydroxy compound according to the present invention, a binder resin and, if necessary, a charge transporting substance other than the asymmetric bishydroxy compound according to the present invention are dissolved or dispersed, for example, in an appropriate organic solvent, and thus, an application liquid for the formation of a surface protective layer is prepared, and this application liquid for the formation of a surface protective layer is applied to the surface of the photosensitive layer 2 or 7 and dried so that the organic solvent is removed. As the organic solvent used here, the same organic solvent as that used for the formation of the photosensitive layer 2 can be used. No crystallization of the asymmetric bishydroxy compound according to the present invention occurs even during the process of forming the surface protective layer 5, and therefore, a surface protective layer 5 where an asymmetric bishydroxy compound according to the present invention is uniformly dispersed can be formed according to the present invention.

Though the film thickness of the surface protective layer 5 is not particularly limited, it is preferably 0.5 μm to 10 μm, and it is more preferably 1 μm to 5 μm. In the case where the film thickness of the surface protective layer 5 is less than 0.5 μm, abrasion resistance of the surface of the electrophotoconductor is low and the durability is insufficient. In the case where the film thickness exceeds 10 μm, the resolution of the electrophotoconductor is low.

Intermediate Layer

The intermediate layer 6 has a function of preventing the injection of charge from the conductive support 1 to the photosensitive layer 2 or 7. As a result, a reduction in electrostatic properties of the photosensitive layer 2 or 7 is suppressed, and a reduction in the charge on the surface, excluding the portions where the charge is to be erased through exposure to light, is suppressed, and thereby, the occurrence of image defects, such as overlapping, can be prevented.

In particular, at the time of the image formation during the process of reversal development, the occurrence of image overlapping, which is referred to as black spots where microscopic black dots are formed of the toner on white background portions, can be prevented. In addition, the surface of the conductive support 1 is coated with the intermediate layer 6, and thereby, the degree of unevenness, which is the defect of the surface of the conductive support 1, is lessened so that the surface is made uniform, and thus, the ease of film formation for the photosensitive layer 2 or 7 is enhanced, and the adhesiveness between the conductive support 1 and the photosensitive layer 2 or 7 can be increased.

The intermediate layer 6 can be formed in such a manner that an application liquid for the formation of an intermediate layer is prepared by, for example, dissolving a resin material in an appropriate solvent, and this application liquid is applied to the surface of the conductive support 1, and the solvent in this application liquid is remove by means of heating. As the resin material for forming the resin layer, thermoplastic resins, such as polyethylene, polypropylene, polystyrene, acrylic resins, vinyl chloride resins, vinyl acetate resins, polyester, polycarbonate, polyester carbonate, polysulfone, polyvinyl butyral, polyamide and polyarylate, thermosetting resins, such as polyurethane, epoxy resins, melamine resins, phenoxy resins and silicone resins, copolymer resins which contain two or more of component units which are included in these thermoplastic resins and thermosetting resins, and natural polymer materials, such as casein, gelatin, polyvinyl alcohol and ethyl cellulose, can be cited.

As the solvent in which the resin material is dissolved or dispersed, water, alcohols, such as methanol, ethanol and butanol, grimes, such as methyl Carbitol and butyl Carbitol, and mixed solvents where two or more types of these solvents are mixed can be cited.

Furthermore, particles of metal oxide may be added to the application liquid for the formation of an intermediate layer. The volume resistance value of the intermediate layer 6 can be easily adjusted by adding particles of metal oxide, and the injection of charge from the conductive support 1 to the photosensitive layer 2 or 7 can further by suppressed, and in addition, the electrical properties of the electrophotoconductor can be maintained in a variety of environments. As the particles of metal oxide, titanium oxide, aluminum oxide, aluminum hydroxide and tin oxide can be cited as examples. A general particle dispersing apparatus, such as a ball mill, a sand mill, an attritor, a vibration mill or an ultrasonic dispersing machine, can be used in order to disperse fine particles of metal oxide in the application liquid for the formation of an intermediate layer.

When the total content of the resin material and the particles of metal oxide in the application liquid for the formation of an intermediate layer, which includes a resin material and particles of metal oxide, is denoted as C and the content of the solvent is denoted as D, the ratio of the two (C/D) is preferably 1/99 to 40/60 (0.01 to 0.67 in weight ratio), and it more preferably 2/98 to 30/70 (0.02 to 0.43 in weight ratio).

In addition, the ratio (E/F) of the content of the resin material (E) to the content of the particles of metal oxide (F) is preferably 1/99 to 90/10 (0.01 to 9.0 in weight ratio), and it is more preferably 5/95 to 70/30 (0.05 to 2.33 in weight ratio).

Though the film thickness of the intermediate layer 6 is not particularly limited, it is preferably 0.01 μm to 20 μm, and it is more preferably 0.1 μm to 10 μm. In the case where the film thickness is less than 0.01 μm, the film does not function sufficiently as the intermediate layer 6, failing to coat the defects of the conductive support 1 and to provide a uniform surface, and in addition, the injection of charge from the conductive support 1 to the photosensitive layer 2 or 7 cannot be prevented, and therefore, the electrostatic properties of the photosensitive layer 2 or 7 are reduced. In the case where the film thickness exceeds 20 μm, uniform formation of the intermediate layer 6 becomes difficult, and the sensitivity of the electrophotoconductor becomes low.

Here, a layer containing Alumite (Alumite layer) can be formed on the surface of the conductive support 180 as to be used as the intermediate layer 6.

Figure 9:
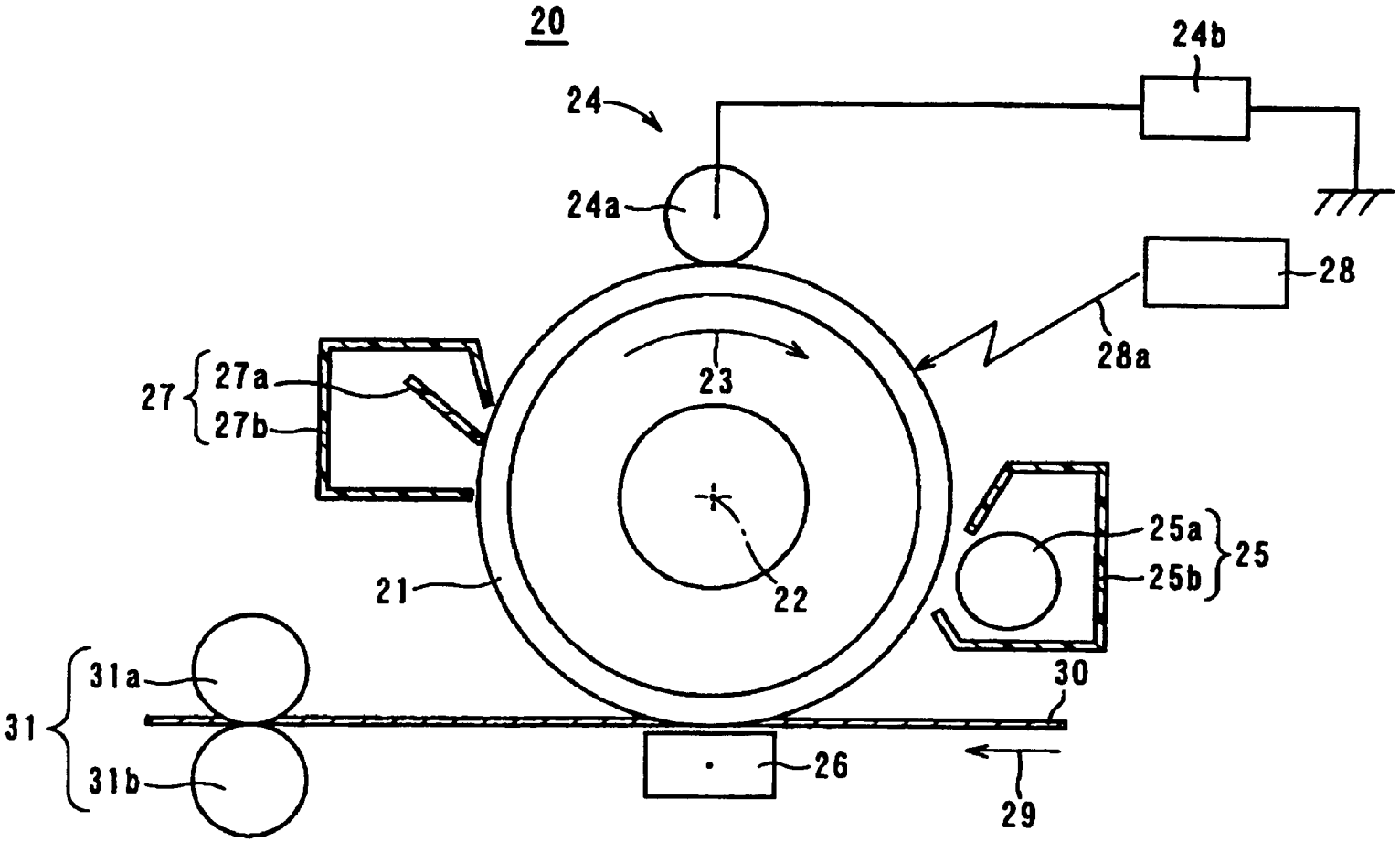
FIG. 9 is a side diagram schematically showing the configuration of an image forming apparatus 20 according to still another embodiment of the present invention.

FIG. 9 is a side diagram schematically showing the configuration of an image forming apparatus 20 according to still another embodiment of the present invention. The image forming apparatus 20 is characterized by being provided with an electrophotoconductor 21 according to the present invention which has the same configuration as any of the above described electrophotographic sensitive bodies 11 to 18 shown in FIGS. 1 to 8. In reference to FIG. 9, the image forming apparatus 20 according to another embodiment of the present invention is described. Here, the image forming apparatus according to the present invention is not limited to those described in the following.

The image forming apparatus 20 is formed so as to include an electrophotoconductor 21 according to the present invention, which is an electrophotoconductor 21 that is supported by the main body of the apparatus, not shown, so as to be freely rotatable, an electrifier 24, a light exposing means 28, a developer 25, a transferring device 26, a cleaner 27 and a fixing device 31.

The electrophotoconductor 21 is driven to rotate in the direction of arrow 23 around the rotational axis line 22 by means of a driving means, not shown. The driving means is formed so as to include, for example, a power motor and speed reducing gears, and transfers the driving force thereof to the conductive support which forms the core of the electrophotoconductor 21 so that the electrophotoconductor 21 is driven to rotate at a predetermined circumferential speed. The electrifier 24, the light exposing means 28, the developer 25, the transferring device 26 and the cleaner 27 are provided along the outer peripheral surface of the electrophotoconductor 21 in this order from the upstream side to the downstream side in the direction of rotation of the electrophotoconductor 21 shown by the arrow 23.

The electrifier 24 is an electrifying means for charging the outer peripheral surface of the electrophotoconductor 21 to a predetermined potential. According to the present embodiment, the electrifier 24 is implemented using a contact style electrifying roller 24*a* and a bias power supply 24*b* for applying a voltage to the electrifying roller 24*a*. Though a charger wire can also be used as the electrifying means, an electrophotoconductor where a surface protective layer is formed according to the present invention provides great effects in increasing the durability of an electrifying roller where a high abrasion resistance is required on the surface of the photoconductor.

The light exposing means 28 is provided with, for example, a semiconductor laser as a light source, and light 28*a*, such as a laser beam outputted from the light source, is radiated between the electrifier 24 and the developer 25 in the electrophotoconductor 21, and thereby, the charged outer peripheral surface of the electrophotoconductor 21 is exposed to light corresponding to image information. Light 28*a* scans repeatedly in the direction in which the rotational axis line 22 of the electrophotoconductor 21 extends, which is the main direction of scanning, and at the same time as this, electrostatic latent images are sequentially formed on the surface of the electrophotoconductor 21.

The developer 25 is a developing means for developing the electrostatic latent images which are formed on the surface of the electrophotoconductor 21 through exposure to light using a developing agent, is provided so as to face the electrophotoconductor 21, and has a developing roller 25*a* for supplying the toner to the outer peripheral surface of the electrophotoconductor 21 as well as a casing 25*b* for supporting the developing roller 25*a* around the rotational axis line parallel to the rotational axis line 22 of the electrophotoconductor 21, that the developing roller is rotatable and for containing developing agents, including the toner, within the inside space thereof.

The transferring device 26 is a transferring means for transferring a toner image, which is a visible image formed on the outer peripheral surface of the electrophotoconductor 21, through development to transfer paper 30, which is a recording medium, and is supplied between the electrophotoconductor 21 and the transferring device 26 in the direction of arrow 29 by means of a conveying means, not shown. The transferring device 26 is a non-contact type transferring means which has, for example, a charging means and transfers a toner image to transfer paper 30 by providing a charge, of which the polarity is opposite to that of the toner, to transfer paper 30.

The cleaner 27 is a cleaning means for removing and collecting the toner which remains on the outer peripheral surface of the electrophotoconductor 21 after the transferring operation of the transferring device 26, and has a cleaning blade 27*a* for removing the toner which remains on the outer peripheral surface of the electrophotoconductor 21 and a casing for collection 27*b*, which contains the toner removed by the cleaning blade 27*a*. In addition, this cleaner 27 is provided together with a charge removing lamp, not shown.

In addition, the image forming apparatus 20 is provided with a fixing device 31, which is a fixing means for fixing a transferred image, on the downstream side in the direction in which transfer paper 30 that has passed between the electrophotoconductor 21 and the transferring device 26 is conveyed. The fixing device 31 has a heating roller 31*a* having a heating means, not shown, and a pressing roller 31*b* which is provided so as to face the heating roller 31*a*, and where a contact portion is formed when pressed by the heating roller 31*a*.

The image formation operation of this image forming apparatus 20 is carried out as follows. First, when the electrophotoconductor 21 is driven by a driving means so as to rotate in the direction of arrow 23, the surface of the electrophotoconductor 21 is uniformly charged to a predetermined positive or negative potential by an electrifier 24 which is provided on the upstream side in the direction of the rotation of the electrophotoconductor 21 relative to the image formation point of light 28*a* from the light exposing means 28.

Next, the surface of the electrophotoconductor 21 is irradiated with light 28*a* from the light exposing means 28, corresponding to image information. In the electrophotoconductor 21, the charge on the surface of the portions which are irradiated with light 28*a* is removed through this exposure to light so that there is a difference between the surface potential of the portions which are irradiated with light 28*a* and the surface potential of the portions which are not irradiated with light 28*a*, and thus, an electrostatic latent image is formed.

The toner is supplied to the surface of the electrophotoconductor 21 where the electrostatic latent image is formed from the developer 25 which is provided on the downstream side in the direction of the rotation of the electrophotoconductor 21 relative to the image formation point of light 28*a* from the light exposing means 28, and then, the electrostatic latent image is developed and a toner image is formed.

Transfer paper 30 is supplied between the electrophotoconductor 21 and the transfer device 26 in sync with the exposure of the electrophotoconductor 21 to light. The transfer device 26 provides a charge, of which the polarity is opposite to that of the toner to the supplied transfer paper 30, and thus, the toner image formed on the surface of the electrophotoconductor 21 is transferred to transfer paper 30.

The transfer paper 30, to which the toner image has been transferred, is conveyed to the fixing device 31 by a conveying means, and then, heated and pressed when passing through the contact portion between the heating roller 31*a* and the pressing roller 31*b* in the fixing device 31 so that the toner image is fixed to the transfer paper 30, forming a solid image. The transfer paper 30 on which an image has been formed in this manner is dispensed to the outside of the image forming apparatus 20 by a conveying means.

Meanwhile, the toner which remains on the surface of the electrophotoconductor 21 after the transfer of a toner image by means of the transfer device 26 is peeled from the surface of the electrophotoconductor 21 by the cleaner 27 so as to be collected. The charge on the surface of the electrophotoconductor 21, from which the toner has been removed in this manner, is removed by light from the charge removing lamp, and thus, the electrostatic latent image on the surface of the electrophotoconductor 21 is erased. After that, the electrophotoconductor 21 is further driven so as to rotate, and a series of operations starting from recharging is repeated so that images are formed sequentially.

The image forming apparatus 20 according to the present invention is provided with an electrophotoconductor 21 having a photosensitive layer or a surface protective layer where an asymmetric bishydroxy compound according to the present invention is uniformly dispersed, and therefore, a high quality image having no image defects, such as black dots, can be formed.

EXAMPLES

In the following Production Examples, Examples and comparative examples are cited, and thereby, the present invention is described concretely, but the present invention is not limited to any of the following examples.

Here, for the compounds obtained in the following Production Examples and Examples, the molecular weight was measured and element analysis was carried out using the following apparatuses in the following conditions.

Molecular weight measuring apparatus: LC-MS (Finnigan LCQ Deca Mass Spectrometer System made by ThermoQuest GmbH)

LC column: GL-Sciences Inertsil ODS-3 2.1×100 mm

Temperature of the column: 40° C.

Eluent: methanol: water=90:10

Amount of sample injected: 5 μl

Detector: UV 254 nm and MS ESI

Element analyzing apparatus: Elemental Analysis 2400, made by PerkinElmer Inc.

Amount of sample: approximately 2 mg precisely weighed

Amount of flowing gas (ml/min): He: 1.5, $O_2$: 1.1, $N_2$: 4.3

Set temperature for combustion tube: 926° C.

Set temperature for reduction tube: 640° C.

Here, in the element analysis, quantitative determination was carried out simultaneously on carbon (C), hydrogen (H) and nitrogen (N) in accordance with a differential thermal conductivity method.

Production Example 1

Exemplified Compound No. 1 (compound (1aa)) was manufactured in accordance with the below described response scheme.

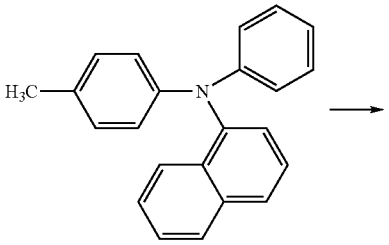

(6a)

-continued

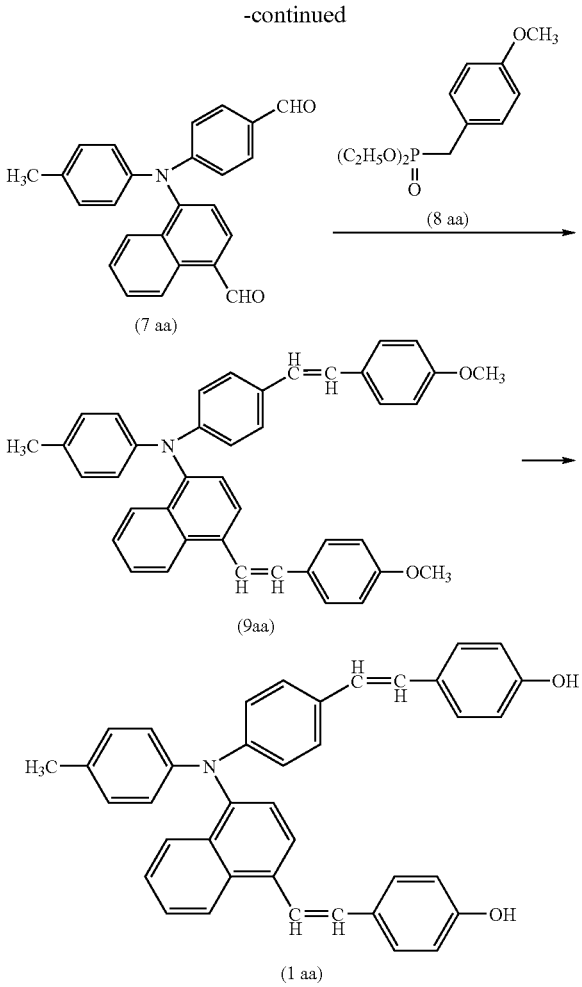

Manufacture of Amine-Bisaldehyde Intermediate (7aa)

18.4 g (2.4 equivalents) of oxyphosphorous chloride was gradually added to 100 ml of N,N-dimethyl formamide anhydride (abbreviated as DMF) while being cooled with ice, and the mixture was stirred for approximately 30 minutes, and thus, a Vilsmeier reagent was prepared. 15.5 g (1.0 equivalent) of N-a-naphthyl-N-phenyl-p-toluidine (6a) was gradually added to the above described solution while being cooled with ice. After that, the mixture was gradually heated and the temperature was raised to 110° C. for reaction, and the mixture was stirred for three hours while heating so that the temperature was maintained at 110° C. After the completion of the reaction, this reacted solution was left and cooled and was gradually added to 800 ml of a cooled 4 N solution of sodium hydroxide, and then the generated precipitation was separated through filtering, sufficiently washed with water, and after that, dissolved in a mixed solvent of ethanol and ethyl acetate (ethanol: ethyl acetate=8:2 to 7:3) and was recrystallized, and thereby, 14.6 g of a compound in yellow powder form was obtained.

As a result of the analysis of the obtained compound in yellow powder form, a peak corresponding to a molecular ion $[M+H]^+$, where a proton was added to the compound (calculated value of molecular weight: 365.14) having chemical structure formula (7aa), was observed at 366.4, and therefore, it was found that this compound was an amine-bisaldehyde intermediate (7aa) represented by chemical structure formula (7aa) (yield: 80%).

In addition, it was found out from the results of the analysis of HPLC at the time of measurement in an LC-MS that purity of the obtained amine-bisaldehyde intermediate (7aa) was 97.2%.

Manufacture of Asymmetric Bis(alkoxyamine) Compound (9aa)

7.26 g of the amine-bisaldehyde intermediate (7aa) (1.0 equivalent) and 12.41 g of diethyl-p-methoxy benzyl phosphonate (8aa) (2.4 equivalents) were dissolved in 80 ml of DMF anhydride, and 5.6 g of potassium t-butoxide (2.5 equivalents) was gradually added to the solution at 0° C. After that, the solution was left for one hour at room temperature, and furthermore, heated to 50° C. and then stirred for five hours while heating so that the temperature was maintained at 50° C. After the reacted mixture was left and cooled, it was poured into an excessive amount of methanol. The precipitation was collected and dissolved in toluene so that a toluene solution was obtained. This toluene solution was transferred to a separating funnel and washed with water, and after that, the organic layer was taken out, and then, the organic layer that was taken out was dried with magnesium sulfate. After drying, the organic layer, from which solids were removed, was concentrated, and a silica gel column chromatography was carried out, and thereby, 9.75 g of yellow crystal was obtained.

As a result of the analysis of the obtained yellow crystal in an LC-MS, a peak corresponding to a molecular ion $[M+H]^+$, where a proton was added to a compound (calculated value of molecular weight: 573.27) represented by chemical structure formula (9aa) was observed at 574.5. From this, it was found that this crystal was an asymmetric bis(alkoxyamine) compound (9aa), which is a precursor of the Exemplified Compound No. 1 (yield: 85%). In addition, it was found from the results of the analysis of HPLC at the time of measurement in an LC-MS that the purity of the obtained compound was 97.7%.

Synthesis of Asymmetric Bishydroxy Compound (1aa) (Exemplified Compound No. 1)

5.7 g of an asymmetric bis(alkoxyamine) compound (9aa) (1.0 equivalent) and 6.39 g of sodium ethane thiol (7.0 equivalents) were suspended in 130 ml of N,N-dimethyl formamide, and the suspension was gradually heated while being stirred and while a flow of nitrogen gas was being provided, and then, foaming started at 130° C. After the foaming was finished, the temperature was further increased and heating reflux was carried out for four hours. After the reacted mixture was left and cooled to room temperature, it was poured into 600 ml of ice water, to which 3.2 ml of concentrated hydrochloric acid was then added while being stirred, and thus, the mixture was neutralized. This was extracted with 400 ml of ethyl acetate, the extracted liquid was washed with water, dried with magnesium sulfate anhydride and removed through filtering, and after that, the solvent was removed and 6.71 g of a coarse crystal was obtained. This was dissolved in a mixed solvent of ethanol and ethyl acetate (ethanol:ethyl acetate=8:2 to 7:3) and recrystallized, and thus, 5.04 g of a compound in yellow powder form was obtained.

The values of element analysis of this compound in yellow powder form are as follows.

Values of Element Analysis of Exemplified Compound No. 1

Theoretical values: C, 85.84%; H, 5.73%; N, 2.57%.

Found values: C, 84.95%; H, 5.18%; N, 2.22%.

In addition, as the results of the analysis of the obtained compound in yellow powder form in an LC-MS, a peak corresponding to a molecular ion $[M+H]^+$, where a proton was added to the compound (calculated value of molecular weight: 545.24) represented by the target chemical structure formula (1aa), was observed at 546.8.

It was found from the results of the element analysis and the analysis in the LC-MS that the obtained compound in yellow powder form was the asymmetric bishydroxy compound (1aa) of the Exemplified Compound No. 1 (yield: 88%). In addition, it was found from the results of the analysis of HPLC at the time of measurement in the LC-MS that the purity of the obtained compound (1aa) was 99.0%.

Production Examples 2 to 10

Syntheses of Exemplified Compounds Nos. 2, 3, 4, 7, 18, 20, 22, 23 and 57

Exactly the same operations were carried out using the respective raw material compounds shown in the following Table 2 as the amine compound, represented by general formula (6), and the Wittig reagent, represented by general formula (8a) or general formula (8b), in Production Example 1 so that Exemplified Compounds Nos. 2, 3, 4, 7, 18, 20, 22, 23 and 57 were respectively manufactured. Here, Table 2 shows the raw material compounds of Exemplified Compound No. 1 together.

TABLE 2

| Compound | Amine compound general formula (6) | Wittig reagent general formula (8a) or (8b) |
|---|---|---|
| Production Example 1 Exemplified Compound No. 1 | 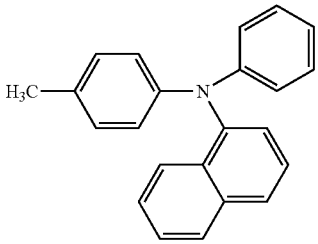 | 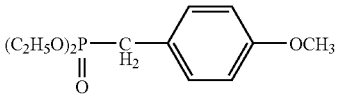 |
| Production Example 2 Exemplified Compound No. 2 | 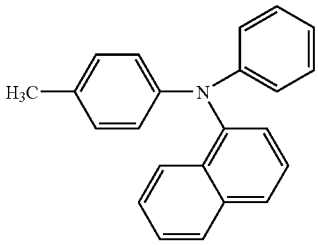 | 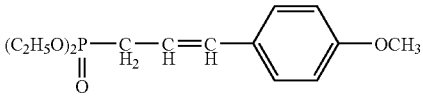 |
| Production Example 3 Exemplified Compound No. 3 | 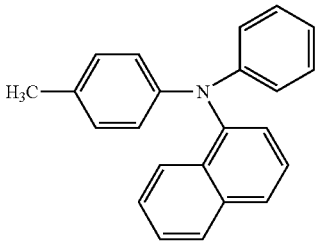 | 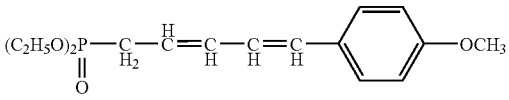 |
| Production Example 4 Exemplified Compound No. 4 | 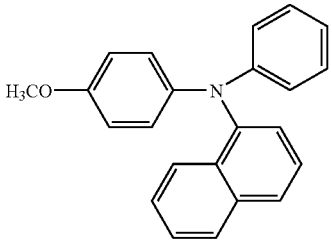 | 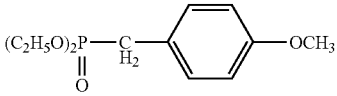 |

TABLE 2-continued

| Compound | Amine compound general formula (6) | Wittig reagent general formula (8a) or (8b) |
|---|---|---|
| Production Example 5 Exemplified Compound No. 7 | 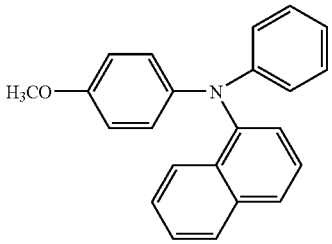 | 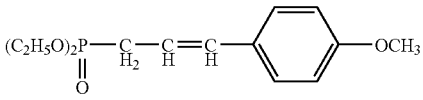 |
| Production Example 6 Exemplified Compound No. 18 | 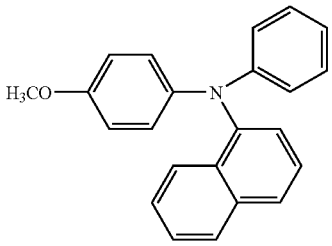 | 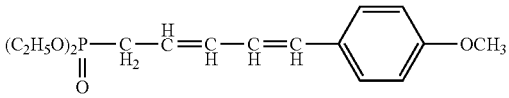 |
| Production Example 7 Exemplified Compound No. 20 | 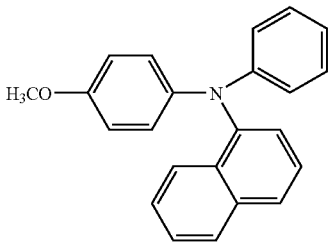 | 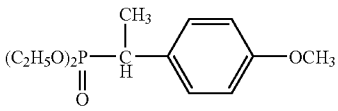 |
| Production Example 8 Exemplified Compound No. 22 | 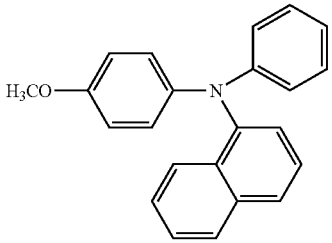 | 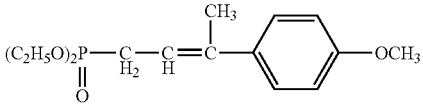 |
| Production Example 9 Exemplified Compound No. 23 | 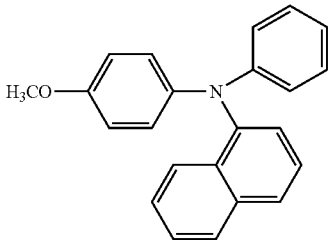 | 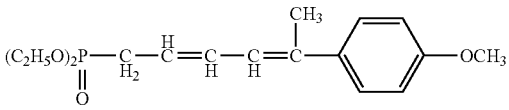 |
| Production Example 10 Exemplified Compound No. 57 | 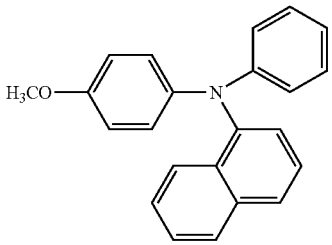 | 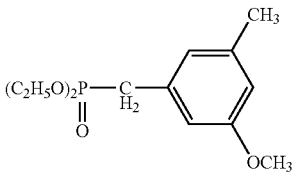 |

In addition, Table 3 shows the values of element analysis of the respective exemplified compounds obtained in the above described Production Examples 1 to 10, the calculated values of the molecular weight and the measured values [M+H] in an LC-MS.

TABLE 3

| compound | structure formula | element analysis C (%) H (%) N (%) | LC - MS |
|---|---|---|---|
| Production Example 1 Exemplified Compound No. 1 | 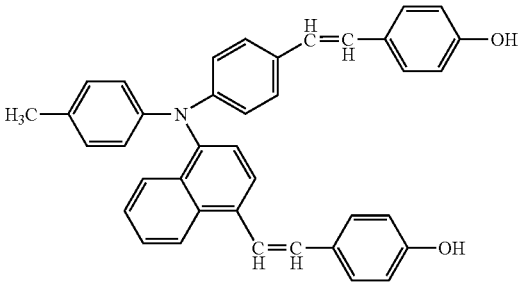 | theoretical values 85.84 5.73 2.57<br>found values 85.69 5.61 2.41 | calculated value 545.68<br>measured values [M + H]+ 546.4 |
| Production Example 2 Exemplified Compound No. 2 | 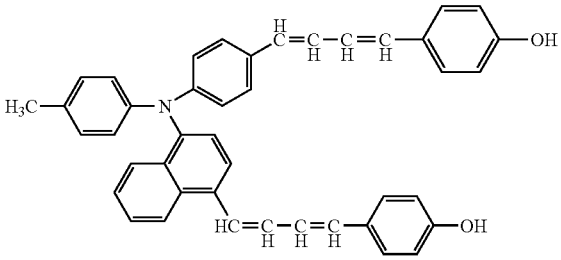 | theoretical values 86.40 5.90 2.34<br>found values 85.21 5.76 2.19 | calculated value 597.75<br>measured values [M + H]+ 598.8 |
| Production Example 3 Exemplified Compound No. 3 | 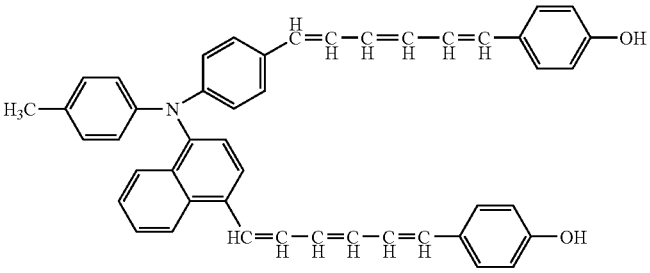 | theoretical values 86.87 6.05 2.16<br>found values 85.92 5.94 2.01 | calculated value 649.30<br>measured values [M + H]+ 650.7 |
| Production Example 4 Exemplified Compound No. 4 | 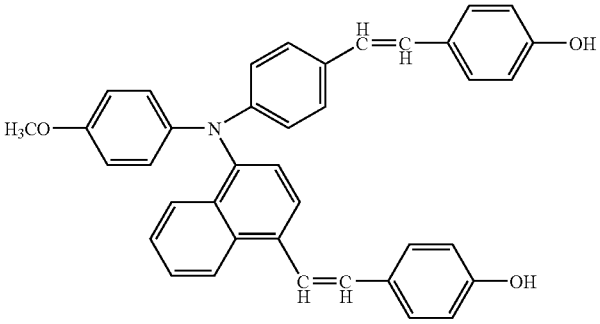 | theoretical values 83.40 5.56 2.49<br>found values 81.95 5.43 2.37 | calculated value 561.23<br>measured values [M + H]+ 562.7 |

TABLE 3-continued

| compound | structure formula | element analysis C (%) H (%) N (%) | LC - MS |
|---|---|---|---|
| Production Example 5 Exemplified Compound No. 7 | 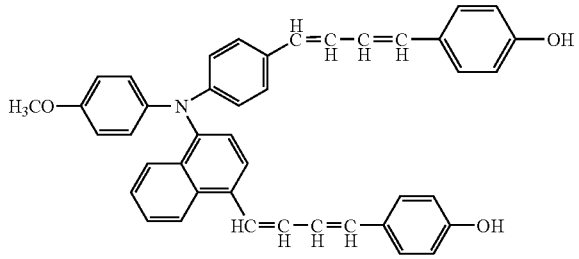 | theoretical values 84.15 5.75 2.28<br>found values 83.07 5.62 2.09 | calculated value 613.26<br>measured values [M + H]+ 614.8 |
| Production Example 6 Exemplified Compound No. 18 | 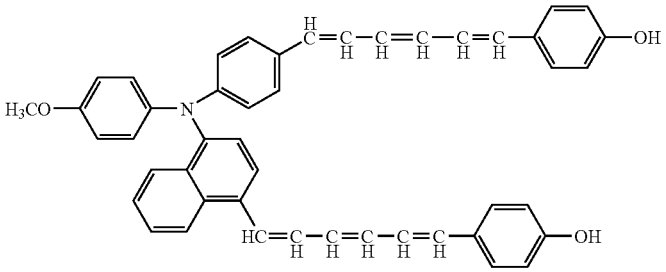 | theoretical values 84.78 5.90 2.10<br>found values 83.66 5.78 1.97 | calculated value 665.29<br>measured values [M + H]+ 666.7 |
| Production Example 7 Exemplified Compound No. 20 | 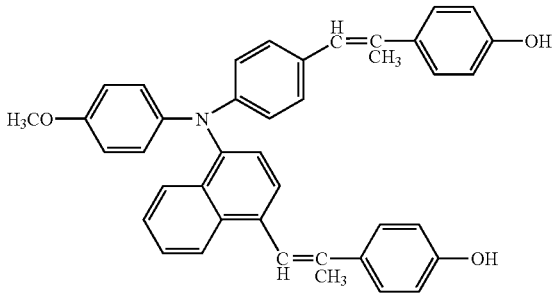 | theoretical values 83.50 5.98 2.38<br>found values 82.48 5.79 2.24 | calculated value 589.26<br>measured values [M + H]+ 590.6 |
| Production Example 8 Exemplified Compound No. 22 | 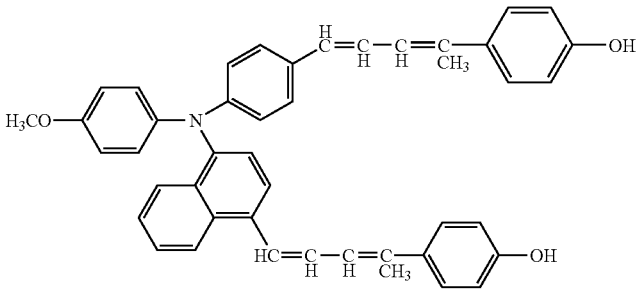 | theoretical values 84.21 6.12 2.18<br>found values 83.12 5.98 2.01 | calculated value 641.29<br>measured values [M + H]+ 642.8 |
| Production Example 9 Exemplified Compound No. 23 | 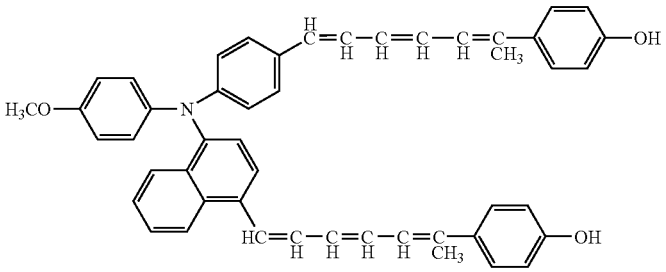 | theoretical values 84.82 6.25 2.02<br>found values 83.65 6.14 1.87 | calculated value 693.32<br>measured values [M + H]+ 694.5 |

TABLE 3-continued

| compound | structure formula | element analysis C (%) H (%) N (%) | LC - MS |
|---|---|---|---|
| Production Example 10 Exemplified Compound No. 57 | 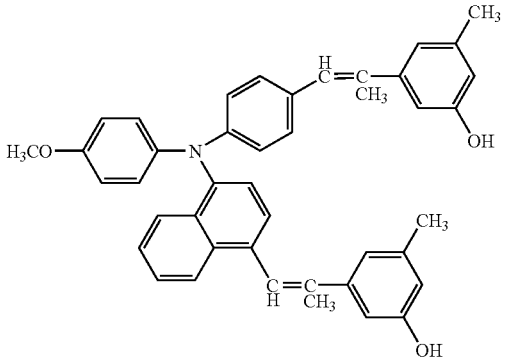 | theoretical values 83.51 6.69 2.21<br>found values 82.17 6.54 2.07 | calculated value 632.32<br>measured values [M + H]+ 633.6 |

Production Example 11

Synthesis of Symmetric Bishydroxy Enamine Compound for Comparison 4.21 g of a symmetric bishydroxy enamine compound, represented by the following chemical structure formula (11) (hereinafter referred to as "symmetric bishydroxy enamine compound (11)") which is Exemplified Compound (EA-14) described in Example 1 of JP-A 2004-269377, was obtained in the same manner as in Production Example 1, except that 16.9 g of an enamine compound (1.0 equivalent) which is synthesized from diphenyl amine and diphenyl acetaldehyde was used as an amine compound.

(11)

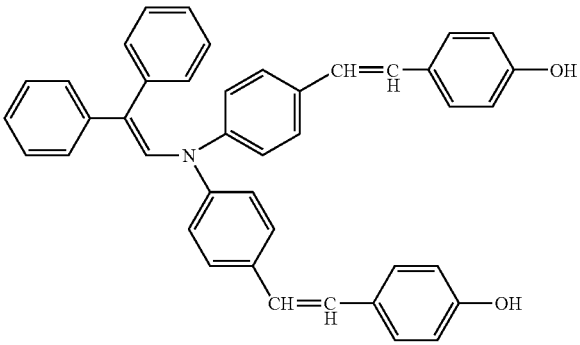

The values of the element analysis of the obtained symmetric bishydroxy enamine compound (11) were as follows.

Value of Element Analysis of Symmetric Bishydroxy Enamine Compound (11)

Theoretical values: C, 86.42%; H, 5.70%; N, 2.40%.

Found values: C, 85.97%; H, 5.38%; N, 2.27%.

In addition, as the results of the analysis of the obtained symmetric bishydroxy enamine compound (11) in an LC-MS, a peak corresponding to the molecular ion $[M+H]^+$, where a proton was added to the compound (calculated value of molecular weight: 583.73) represented by the target chemical structure formula (11), was observed at 584.9.

It was found from the element analysis and the results of the analysis in the LC-MS that the obtained compound was the symmetric bishydroxy enamine compound (11) which is Exemplified Compound (EA-14) described in JP-A 2004-269377 (yield: 83%). In addition, it was found from the results of the analysis of HPLC at the time of measurement in the LC-MS that the purity of the obtained compound (11) was 98.3%.

Example 1

An electrophotoconductor using Exemplified Compound No. 1, which is the asymmetric bishydroxy compound according to the present invention manufactured in Production Example 1 as a charge transporting substance in the charge transporting layer, was fabricated in the following manner. A polyethylene terephthalate (abbreviated as PET) film having a thickness of 100 μm on which the surface aluminum was vapor deposited (hereinafter referred to as "aluminum vapor deposited PET film") was used as the conductive support.

7 weight parts of titanium oxide (trade name: TIBAKE TTO55A, made by Ishihara Sangyo Kaisha, Ltd.) and 13 weight parts of a copolymerized nylon resin (trade name: AMILAN CM8000, made by Toray Industries, Inc.) were added to a mixed solvent of 159 weight parts of methyl alcohol and 106 weight parts of 1,3-dioxolane, and a dispersing process was carried out for 8 hours using a paint shaker, and thus, 100 g of an application liquid for forming an intermediate layer was prepared. This application liquid for forming an intermediate layer was applied to the surface of aluminum of the aluminum vapor deposited PET film, which is the conductive support using an applicator, and was dried naturally so that an intermediate layer having a film thickness of 1 μm was formed.

Next, 1 weight part of X type non-metal phthalocyanine FASTOGEN Blue 8120, made by Dainippon Ink and Chemicals, Incorporated) and 1 weight part of a butyral resin (trade name: #6000-C, made by Denki Kagaku Kogyo Kabushiki Kaisha) were mixed into 98 weight parts of methyl ethyl ketone, and a dispersing process was carried out using a paint shaker, and thus, 50 g of an application liquid for forming a charge generating layer was prepared. This application liquid for forming a charge generating layer was applied to the surface of the previously provided intermediate layer in accordance with the same method as that for the above described intermediate layer, and was dried naturally so that a charge generating layer having a film thickness of 0.4 μm was formed.

Next, 100 weight parts of the asymmetric bishydroxy compound, which is Exemplified Compound No. 1 manufactured in Production Example 1, and 100 weight parts of a polycarbonate resin (trade name: IUPILON Z400, made by Mitsubishi Gas Chemical Company, Inc.) were mixed with each other, and 10 g of an application liquid for forming a charge transporting layer, with 10 wt % of solid components was prepared using toluene as the solvent. This application liquid for forming a charge transporting layer was applied to the surface of the previously provided charge generating layer in accordance with the same method as that for the above described intermediate layer, and after that, dried for one hour at 110° C. so that a charge transporting layer having a film thickness of 20 μm was formed. In this manner, a multilayer type electrophotoconductor according to the present invention, having a multilayer structure where an intermediate layer, a charge generating layer and a charge transporting layer were sequentially layered on a conductive support in the same manner as in the above described electrophotoconductor 17 shown in FIG. 7, was fabricated.

Examples 2 to 5

A multilayer type electrophotoconductor according to the present invention, having a multilayer structure where an intermediate layer, a charge generating layer and a charge transporting layer were sequentially layered on a conductive support, was fabricated in exactly the same manner as in Example 1, except that Exemplified Compound 3, 18, 22 or 23 was used instead of Exemplified Compound No. 1, which was an asymmetric bishydroxy compound according to the present invention.

Example 6

Fabrication of electrophotoconductor using Exemplified Compound No. 1, which was asymmetric bishydroxy compound according to the present invention manufactured in Production Example 1, as charge transporting substance in surface protective layer An intermediate layer having a film thickness of 1 μm and a charge generating layer having a film thickness of 0.4 μm were sequentially formed on the surface of the aluminum of a conductive support which was formed by vapor depositing aluminum on the surface of a PET film having a thickness of 100 μm in the same manner as Example 1.

Next, a charge transporting layer was formed in exactly the same manner as in Example 1, except that a butadiene compound, represented by the following chemical structure formula (12) (1,1-bis(p-diethyl amino phenyl)-4,4-diphenyl-1,3-butadiene, trade name: T405, made by Takasago Chemical Corporation), was used instead of Exemplified Compound No. 1, which was an asymmetric bishydroxy compound according to the present invention.

Here, in the following, the butadiene compound represented by chemical structure formula (12) is referred to as "butadiene compound (12)."

(12)

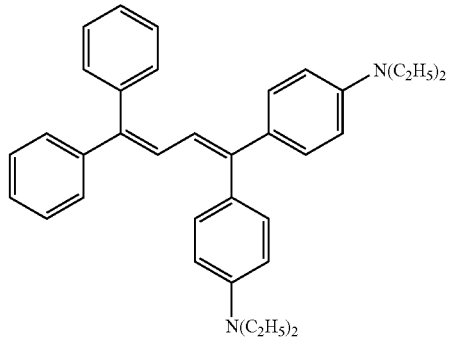

Next, 60 weight parts of a setting siloxane resin (trade name: KP-854, made by Shin-Etsu Chemical Co., Ltd.) and 60 weight parts of isopropanol were mixed together so that the solid was uniformly dissolved in the liquid, and 6 weight parts of the asymmetric bishydroxy compound, which is Exemplified Compound No. 1 manufactured in Production Example 1, was added to the above described mixture, and thus, 10 g of an application liquid for forming a surface protective layer was prepared. This application liquid for forming a surface protective layer was applied to the surface of the charge transporting layer in the same manner as in the case of the formation of an intermediate layer in Example 1, and dried for one hour at 120° C. so that a surface protective layer having a film thickness of 1 μm was formed. In this manner, a multilayer type electrophotoconductor according to the present invention, having a multilayer structure, where an intermediate layer, a charge generating layer, a charge transporting layer and a surface protective layer were sequentially layered on a conductive support in the same manner as in the above described electrophotoconductor 18 shown in FIG. 8, was fabricated.

Examples 7 to 11

A multilayer type electrophotoconductor according to the present invention, having a multilayer structure where an intermediate layer, a charge generating layer, a charge transporting layer and a surface protective layer were sequentially layered on a conductive support, was fabricated in exactly the same manner as in Example 6, except that Exemplified Compound 2, 4, 7, 20 or 57 was used instead of Exemplified Compound No. 1, which was an asymmetric bishydroxy compound according to the present invention.

Comparative Example 1

A multilayer type electrophotoconductor was fabricated in the same manner as in Example 1, except that the symmetric bishydroxy enamine compound (11) manufactured in Production Example 11 was used instead of Exemplified Compound No. 1, which was an asymmetric bishydroxy compound according to the present invention, at the time of the formation of the charge transporting layer.

Evaluation of Electrical Properties

The electrical properties of electrophotographic sensitive bodies obtained in Examples 1 to 11 and Comparative Example 1, respectively, were evaluated using an electrostatic paper testing apparatus (trade name: EPA-8200, made by Kawaguchi Electric Works Co., Ltd.) in the following manner.

A voltage of minus (−) 5 kV was applied to the photoconductor so that the surface of the photoconductor was charged, and the surface potential of the photoconductor at this time was measured as the charge potential V0 (V). Next, the surface of the charged photoconductor was exposed to light, and the amount of light for exposure that was required to reduce the surface potential of the photoconductor to half of the charge potential V0 was measured as half decay exposure $E_{1/2}$ ($\mu J/cm^2$). In addition, the surface potential of the photoconductor at the point in time when 10 sec had passed from the start of exposure to light was measured as the remaining potential Vr (V). Here, light having a wavelength of 780 nm and an intensity of 1 $\mu W/cm^2$ obtained through spectrometry using a monochrome meter was used for the exposure to light.

Evaluation of Image

The states of the images formed on the electrophotographic sensitive bodies obtained in Examples 1 to 11 and Comparative Example 1 were respectively evaluated in the following manner.

A photoconductor drum was removed from a commercially available digital copier (trade name: LIBRE AR-451, made by Sharp Corporation), a portion of the photosensitive layer of this photoconductor drum was removed and an electrophotoconductor (PET film) obtained in Example 1, 2 or Comparative Example 1 was pasted to the portion from which the photosensitive layer was removed in such a manner that the aluminum vapor deposited surface of the electrophotoconductor and the conductive support were electrically connected with an aluminum foil, and the surface of this conductive portion was protected with a cellophane adhesive tape or the like in order to prevent leakage in the developer, and then, the drum was mounted again on the above described copier AR-451.

A half-tone image was formed on a sheet of A3 type paper prescribed by Japanese Industrial Standard (JIS) P0138:1998 using this copier and was used as an image for evaluation. Here, the half-tone image means an image which expressed the gradation of light and shade in the image using white and black dots. The states of the images formed on the portions of the electrophotographic sensitive bodies obtained in Examples 1 to 11 and Comparative Example 1 were evaluated by visually observing the obtained images for evaluation, and the results of the evaluation are shown in the following Table 4.

TABLE 4

| | charge transporting layer | surface protective layer | | | | | |
|---|---|---|---|---|---|---|---|
| | charge transporting material | existence | charge transporting material | VO [V] | $E_{1/2}$ [$\mu J/cm^2$] | Vr [V] | state of image |
| Example 1 | Exemplified Compound No. 1 | non-existent | — | −580 | 0.17 | −12 | excellent |
| Example 2 | Exemplified Compound No. 3 | non-existent | — | −576 | 0.19 | −14 | excellent |
| Example 3 | Exemplified Compound No. 18 | non-existent | — | −582 | 0.18 | −13 | excellent |
| Example 4 | Exemplified Compound No. 22 | non-existent | — | −579 | 0.18 | −15 | excellent |
| Example 5 | Exemplified Compound No. 23 | non-existent | — | −586 | 0.19 | −16 | excellent |
| Example 6 | butadiene compound (12) | exists | Exemplified Compound No. 1 | −585 | 0.2 | −15 | excellent |
| Example 7 | butadiene compound (12) | exists | Exemplified Compound No. 2 | −582 | 0.21 | −14 | excellent |
| Example 8 | butadiene compound (12) | exists | Exemplified Compound No. 4 | −579 | 0.22 | −17 | excellent |
| Example 9 | butadiene compound (12) | exists | Exemplified Compound No. 7 | −586 | 0.19 | −14 | excellent |
| Example 10 | butadiene compound (12) | exists | Exemplified Compound No. 20 | −581 | 0.22 | −13 | excellent |
| Example 11 | butadiene compound (12) | exists | Exemplified Compound No. 57 | −583 | 0.21 | −15 | excellent |
| Comparative Example 1 | symmetric bishydroxy enamine compound (11) | non-existent | — | −580 | 0.22 | −25 | great number of black dots |

It was measured that the sensitive bodies in Examples 1 to 5, where an asymmetric bishydroxy compound according to the present invention was used in the charge transporting layer, and the sensitive bodies in Examples 6 to 10, where the asymmetric bishydroxy compound was used in the surface protective layer, had absolute values of the half decay exposure $E_{1/2}$ and the remaining potential Vr, which are both smaller than those of Comparative Example 1, and thus, were excellent in the sensitivity and responsiveness.

In addition, the states of the images were excellent in Examples 1 to 11, and defects of the images, such as black dots, white dots, black bands or blurriness of the image, did not occur.

In contrast to this, a great number of black dots were generated in the image in Comparative Example 1 where the symmetric bishydroxy enamine compound (11) was used for the charge transporting layer. It is considered that this is because the symmetric bishydroxy enamine compound (11) had a low level of dissolution in the solvent, making portions undissolved in the solvent remain in the charge transporting layer in a crystal state due to the high level of symmetry in the chemical structure, and thus, these portions appeared as black dots in the image.

What is claimed is:

1. An electrophotoconductor, in which a photosensitive layer comprising a charge generating substance and a surface protective layer are layered on a conductive support in this order, and at least one of the photosensitive layer or the surface protective layer contains an asymmetric bishydroxy compound that can be represented by the general formula (1):

(1)

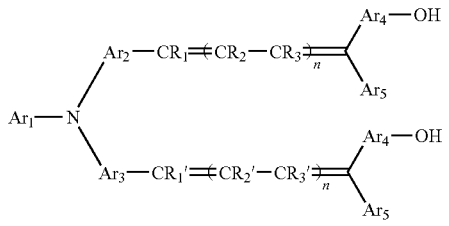

wherein $Ar_1$ is an aryl or heterocyclic group which may have an arbitrary substituent group, $Ar_2$ and $Ar_3$, different each other, are an arylene group or bivalent heterocyclic group which may have an arbitrary substituent group, $Ar_4$ is an arylene or bivalent heterocyclic group which may have an arbitrary substituent group, $Ar_5$ is hydrogen atom or an aryl, aralkyl or alkyl group which may have an arbitrary substituent group, $R_1$ and $R_1'$ are hydrogen atom or an alkyl group which may have an arbitrary substituent group, $R_2$, $R_2'$, $R_3$ and $R_3'$ are hydrogen atom or an alkyl, aryl, heterocyclic or aralkyl group which may have an arbitrary substituent group, provided that $R_1$ and $R_1'$, $R_2$ and $R_2'$, and $R_3$ and $R_3'$ may be the same or different groups, respectively, and n is an integer from 0 to 2.

2. The electrophotoconductor according to claim 1, in which said asymmetric bishydroxy compound of the general formula (1), in which one of $Ar_2$ and $Ar_3$ is phenylene group and the other is naphthylene group and $R_1$, $R_1'$, $R_2$, $R_2'$, $R_3$ and $R_3'$ are all hydrogen atom, can be represented by the following general formula (2):

(2)

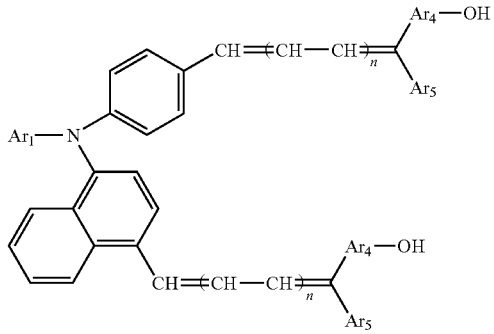

wherein $Ar_1$, $Ar_4$, $Ar_5$ and n are the same meanings as defined in the general formula (1).

3. The electrophotoconductor according to claim 1, in which said asymmetric bishydroxy compound of the general formula (1), in which one of $Ar_2$ and $Ar_3$ is phenylene group and the other is naphthylene group, $Ar_4$ is phenylene group which may have an arbitrary substituent group, $Ar_5$ is hydrogen atom and $R_1$, $R_1'$, $R_2$, $R_2'$, $R_3$ and $R_3'$ are all hydrogen atom, can be represented by the following general formula (3):

(3)

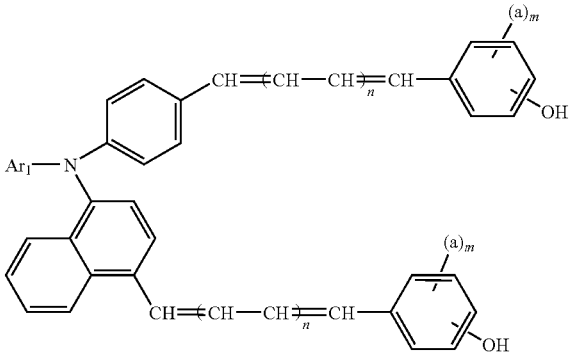

wherein $Ar_1$ and n are the same meanings as defined in the general formula (1), "a" is hydrogen atom or an alkyl group or dialkyl amino group which may have an arbitrary substituent group, and m indicates an integer from 1 to 4, provided that when a exists two or more, a may be the same or different from each other.

4. The electrophotoconductor according to claim 1, in which said asymmetric bishydroxy compound of the general formula (1), in which one of $Ar_2$ and $Ar_3$ is phenylene group and the other is naphthylene group, $Ar_4$ is phenylene group, $Ar_5$ is hydrogen atom and $R_1$, $R_1'$, $R_2$, $R_2'$, $R_3$ and $R_3'$ are all hydrogen atom, can be represented by the following general formula (4):

(4)

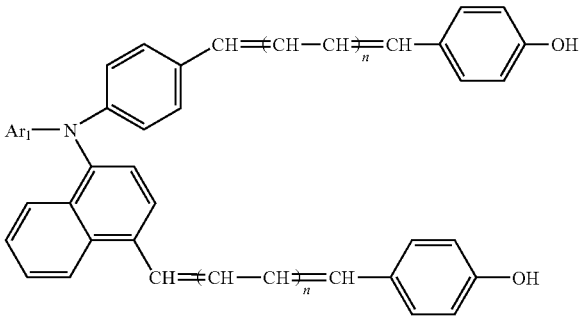

wherein $Ar_1$ and n are the same meanings as defined in the general formula (1).

5. The electrophotoconductor according to claim 1, in which said asymmetric bishydroxy compound of the general formula (1), in which one of $Ar_2$ and $Ar_3$ is phenylene group and the other is naphthylene group, $Ar_4$ is phenylene group, $Ar_5$ is hydrogen atom, $R_1$ and $R_1'$ are both hydrogen atom and n is 0, can be represented by the following general formula (5):

(5)

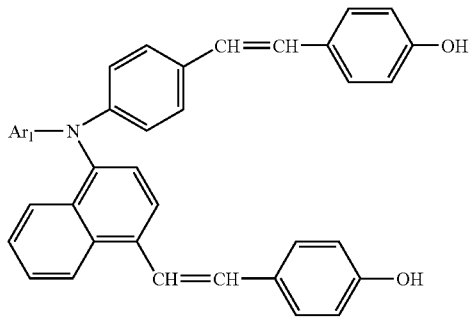

wherein $Ar_1$ is the same meaning as defined in the general formula (1).

6. An electrophotoconductor according to claim 1, in which the said photosensitive layer has a multilayer structure of a charge generating layer which contains a charge generating substance and a charge transporting layer containing the asymmetric bishydroxy compound.

7. An image forming apparatus, comprising:

the electrophotoconductor according to claim 1;

a charging means for charging said electrophotoconductor;

a light exposing means for exposing said charged electrophotoconductor to light; and a developing means for developing an electrostatic latent image formed through exposure to light.

8. An image forming apparatus according to claim 7, in which the said image forming apparatus has a contact charge as the charging means.

* * * * *